US010883257B2

(12) United States Patent
Bjerke et al.

(10) Patent No.: US 10,883,257 B2
(45) Date of Patent: Jan. 5, 2021

(54) SHROUD RETENTION SYSTEM FOR A WORK TOOL

(71) Applicant: CATERPILLAR INC., Deerfield, IL (US)

(72) Inventors: Nathan Bjerke, Peoria, IL (US); Scott A. Schick, Morton, IL (US); Thomas M. Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 151 days.

(21) Appl. No.: 16/181,655

(22) Filed: Nov. 6, 2018

(65) Prior Publication Data

US 2020/0141093 A1 May 7, 2020

(51) Int. Cl.
*E02F 9/28* (2006.01)
*E02F 3/40* (2006.01)

(52) U.S. Cl.
CPC ..... *E02F 9/2841* (2013.01); *E02F 9/2808* (2013.01); *E02F 9/2825* (2013.01)

(58) Field of Classification Search
CPC ..... E02F 9/2841; E02F 9/2808; E02F 9/2825
See application file for complete search history.

(56) References Cited

U.S. PATENT DOCUMENTS 3,664,044 A * 5/1972 Hahn ..... E02F 9/2833 37/456
4,205,469 A 6/1980 Johansson
4,676,706 A 6/1987 Inaba
5,125,853 A 6/1992 Hashiguchi
5,452,529 A * 9/1995 Neuenfeldt et al. .. E02F 9/2825 37/395
5,713,145 A 2/1998 Ruvang
5,778,599 A 7/1998 Saito
(Continued)

FOREIGN PATENT DOCUMENTS

WO WO 2012-016251 2/2012
WO WO 2013-122561 8/2013
WO WO 2016-135360 9/2016

OTHER PUBLICATIONS

U.S. Design Patent Application of Nathan Bjerke et al., titled "Retention Component," filed Nov. 6, 2018.
(Continued)

*Primary Examiner* — Tara Mayo-Pinnock
(74) *Attorney, Agent, or Firm* — Finnegan, Henderson, Farabow, Garrett & Dunner, LLP

(57) ABSTRACT

A shroud retention system for a work tool is disclosed. The shroud retention system may have an adapter attached to the work tool, and a shroud having a channel that slides over the adapter. The channel may have a retainer slot. The shroud retention system may further have a spring assembly disposed in the channel and connectable to the adapter. The spring assembly may have a slide compressor that can slide within the channel relative to the adapter. The slide compressor may have a compressor mating feature. The spring assembly may further have a resilient member disposed between the adapter and the slide compressor. The shroud retention system may have a retainer plate disposed in the retainer slot. The retainer plate may have a retainer mating feature that mates with the compressor mating feature such that the retainer plate and the slide compressor are engaged in a locked position.

21 Claims, 15 Drawing Sheets

(56) References Cited

U.S. PATENT DOCUMENTS

| | | | | |
|---|---|---|---|---|
| 5,806,215 | A | 9/1998 | Matthews | |
| 5,937,550 | A | 8/1999 | Emrich | |
| 5,983,534 | A * | 11/1999 | Robinson et al. | E02F 9/2841 37/452 |
| 6,209,238 | B1 | 4/2001 | Ruvang | |
| 6,240,663 | B1 | 6/2001 | Robinson | |
| 7,219,454 | B2 | 5/2007 | Maher | |
| 7,472,503 | B2 | 1/2009 | Maher | |
| 8,024,874 | B2 | 9/2011 | McClanahan et al. | |
| 8,438,760 | B2 | 5/2013 | Maher et al. | |
| 8,458,931 | B2 * | 6/2013 | Knight | E02F 9/2825 37/456 |
| 8,943,718 | B2 | 2/2015 | Ruvang | |
| 9,540,796 | B2 | 1/2017 | Dallard et al. | |
| 9,909,285 | B2 | 3/2018 | Bjerke et al. | |
| 9,938,695 | B2 | 4/2018 | Bjerke et al. | |
| 2003/0089003 | A1 | 5/2003 | Ollinger, IV et al. | |
| 2003/0121185 | A1 | 7/2003 | Ollinger, IV et al. | |
| 2004/0237355 | A1 | 12/2004 | Ollinger, IV | |
| 2005/0229441 | A1 | 10/2005 | Maher | |
| 2008/0005940 | A1 | 1/2008 | Ollinger | |
| 2009/0282711 | A1 | 11/2009 | Naher et al. | |
| 2009/0285651 | A1 | 11/2009 | Cooley | |
| 2013/0185964 | A1 | 7/2013 | Anisy et al. | |
| 2013/0269221 | A1 | 10/2013 | Pippins | |
| 2014/0173949 | A1 | 6/2014 | Karlsson et al. | |
| 2014/0202049 | A1 | 7/2014 | Ruvang | |
| 2014/0360060 | A1 | 12/2014 | Kunz | |
| 2015/0211214 | A1 | 7/2015 | Dallard et al. | |
| 2017/0073939 | A1 * | 3/2017 | Bjerke et al. | E02F 9/2825 |

OTHER PUBLICATIONS

Search Report and Written Opinion issued by the International Searching Authority in corresponding application PCT/US2019/056661, dated Jan. 27, 2020 (14 pages).

* cited by examiner

SHROUD RETENTION SYSTEM FOR A WORK TOOL

TECHNICAL FIELD

The present disclosure relates generally to a shroud retention system and, more particularly, to a shroud retention system for a work tool.

BACKGROUND

Earth-working machines, such as excavators, shovels, wheel loaders, motor graders, or mining equipment include ground engaging work tools that engage with a variety of earthen or mining materials to excavate and/or move these materials. Typically, such work tools include one or more cutting tools or bits mounted to a ground engaging edge of the work tool, for example, to a lip of a bucket. Exposed portions of the work tool edge, that lie between adjacently placed cutting tools or bits also come into contact with the earthen materials, which may include soil, rocks, or mining materials. Repeated impact of the earthen materials on the exposed portions of the work tool edge can cause significant wear and/or abrasion of these exposed portions. To prolong the useful life of the work tools, wear members or shrouds are often attached to the work tools in the spaces between adjacent cutting tools or bits to protect the exposed portions of the work tool edge.

Although the wear members protect the edge of the work tool, the wear members themselves come into contact with the earthen materials and may experience wear, requiring periodic repair or replacement. Removal and/or replacement of a wear member may require disassembly of the wear member from the edge of the work tool, and assembly of a repaired or a replacement wear member on the work tool. The machine must be taken out of service to perform such replacement or repair. The time required to disassemble and reassemble a wear member depends on the mechanism used to retain the wear member on the work tool. It is desirable to have a retention system that allows for quick assembly and disassembly of the wear members at a worksite to allow the machine to be returned to service as quickly as possible.

U.S. Pat. No. 9,909,285 of Bjerke et al., issued on Mar. 6, 2018 ("the '285 patent"), and discloses a shroud retention system for attaching wear members to the edge of a working tool. In particular, the '285 patent discloses an adapter attached to the work tool. The shroud of the '285 patent includes a channel into which the adapter is received. Additionally, the retention system of the '285 patent includes a spring assembly disposed between the adapter and a retainer plate. The spring assembly includes a resilient member sandwiched between the adapter and a compressor block. The retainer plate abuts a surface of the compressor block and engages with a notch in the work tool so that the shroud is retained between the adapter and the retention plate. Disassembly of the shroud of the '285 patent is accomplished by removing the retainer plate, which allows the shroud to slide out from over the adapter.

Although the '285 patent discloses a shroud retention system that allows for relatively easy assembly and disassembly of the shroud from the working tool, the retention system of the '285 patent may be further improved.

SUMMARY

In one aspect, the present disclosure is directed to a shroud retention system for a work tool. The shroud retention system may include an adapter attached to the work tool. The shroud retention system may also include a shroud. The shroud may include a channel configured to slidably engage with the adapter. The channel may include a retainer slot. The shroud retention system may further include a spring assembly disposed in the channel. The spring assembly may be connectable to the adapter. The spring assembly may include a slide compressor. The slide compressor may be configured to slidably move in the channel relative to the adapter. The slide compressor may also include a compressor mating feature. The spring assembly may further include a resilient member disposed between the adapter and the slide compressor. The resilient member may be configured to be compressed by the slide compressor. The shroud retention system may include a retainer plate disposed in the retainer slot. The retainer plate may include a retainer mating feature configured to matingly engage with the compressor mating feature such that the retainer plate and the slide compressor are engaged in a locked position.

In another aspect, the present disclosure is directed to a slide compressor for attaching a work tool. The slide compressor may include a compressor block. The compressor block may have a compressor front face and a compressor rear face disposed opposite the compressor front face. The compressor rear face may be inclined relative to the compressor front face. The compressor block may have a compressor bottom face extending from the compressor front face to the compressor rear face. The compressor block may also have a compressor top face disposed opposite the compressor bottom face and extending from the compressor front face to the compressor rear face. The slide compressor may include a hole extending between the compressor front face and the compressor rear face. The compressor front face may be disposed generally perpendicular to a longitudinal axis of the hole. The slide compressor may also include a slot extending from the compressor top face towards the compressor bottom face and intersecting with the hole. In addition, the slide compressor may include a protrusion disposed on the compressor rear face.

In yet another aspect, the present disclosure is directed to a retainer plate. The retainer plate may include a retainer front face and a retainer rear face disposed opposite the retainer front face. The retainer may include a retainer portion. The retainer portion may have a retainer bottom face and a retainer top face, both extending between the retainer front face and the retainer rear face. The retainer portion may also have retainer side faces extending between the retainer front face and the retainer rear face. The retainer plate may include a slot extending from the retainer bottom face towards the retainer top face. The retainer plate may also include a recess disposed on at least one of the retainer front face or the retainer rear face.

DETAILED DESCRIPTION

Figure 1:
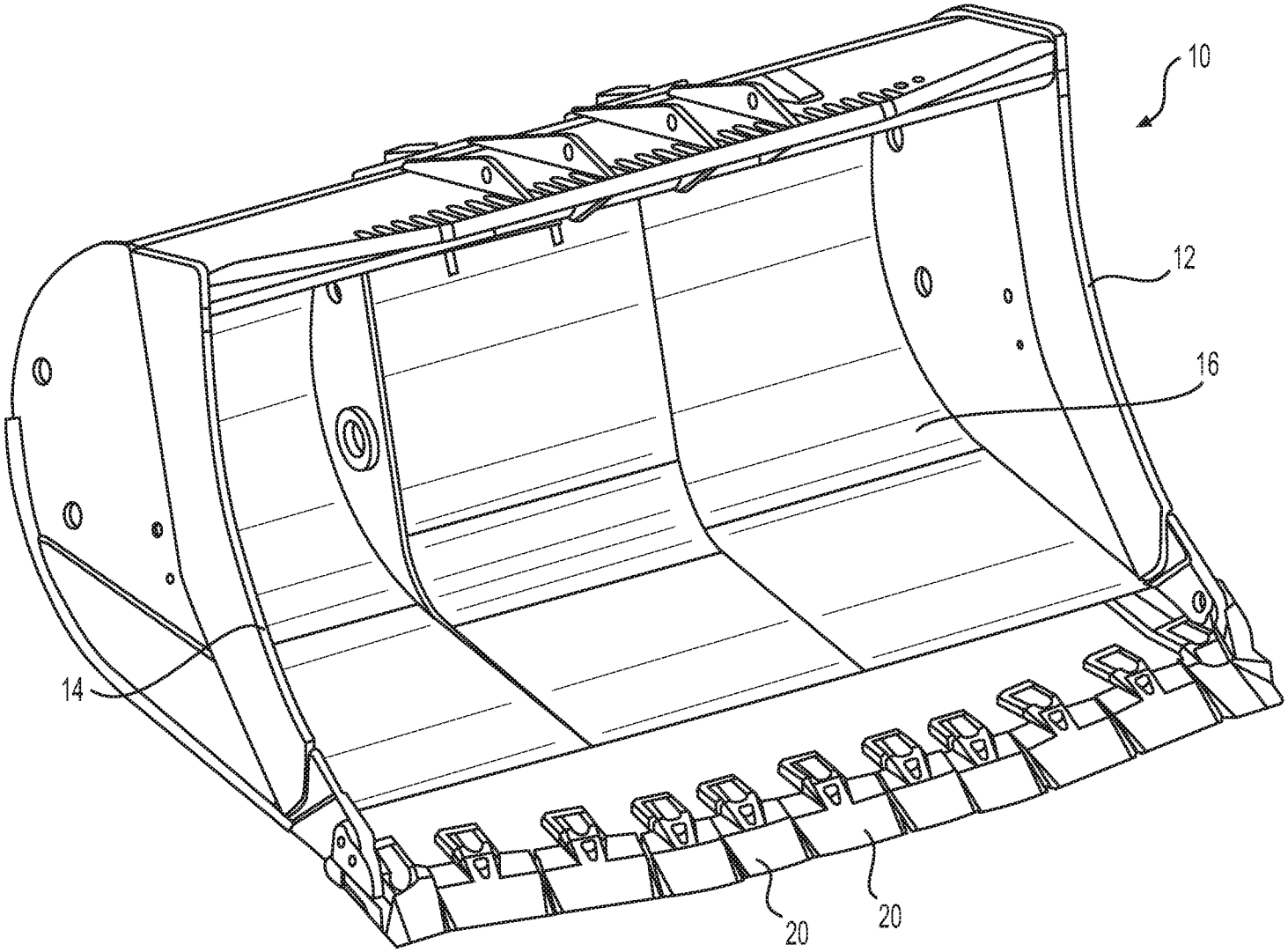
FIG. 1 is an illustration of an exemplary work tool.

FIG. 1 illustrates an exemplary work tool 10 for a machine (not shown). Work tool 10 may embody any device used to perform a task assigned to the machine. For example, work tool 10 may be a bucket (shown in FIG. 1), a blade, a shovel, a crusher, a grapple, a ripper, or any other ground engaging or material moving device known in the art. Work tool 10 may include side walls 12, 14, and primary wall 16, which may form a bottom of work tool 10. Primary wall 16 may extend from side wall 12 to side wall 14. Primary wall 16 of work tool 10 may also include edge 18 (see FIG. 2), extending between side walls 12, 14. Edge 18 may be detachable from work tool 10 or it may be a fixed component of work tool 10.

Work tool 10 may include a plurality of shrouds 20 (or wear members) attached to edge 18. Each shroud 20 may be configured to protect edge 18 from abrasion and wear by reducing or preventing contact of an exposed portion of edge 18 with earthen materials. In some exemplary embodiments, shrouds 20 may be disposed between adjacent tool assemblies (not shown) attached to edge 18 to protect a portion of edge 18 between the adjacent tool assemblies from abrasion and wear.

For the purposes of this disclosure, attention will be focused on attachment of shrouds 20 to work tool 10. It is contemplated, however, that the attachment methods and structures presented in this disclosure may additionally or alternatively be utilized to attach individual tools or bits, tool assemblies, and/or other wear components to edge 18 of work tool 10 or to work tool 10 itself.

Figure 2:
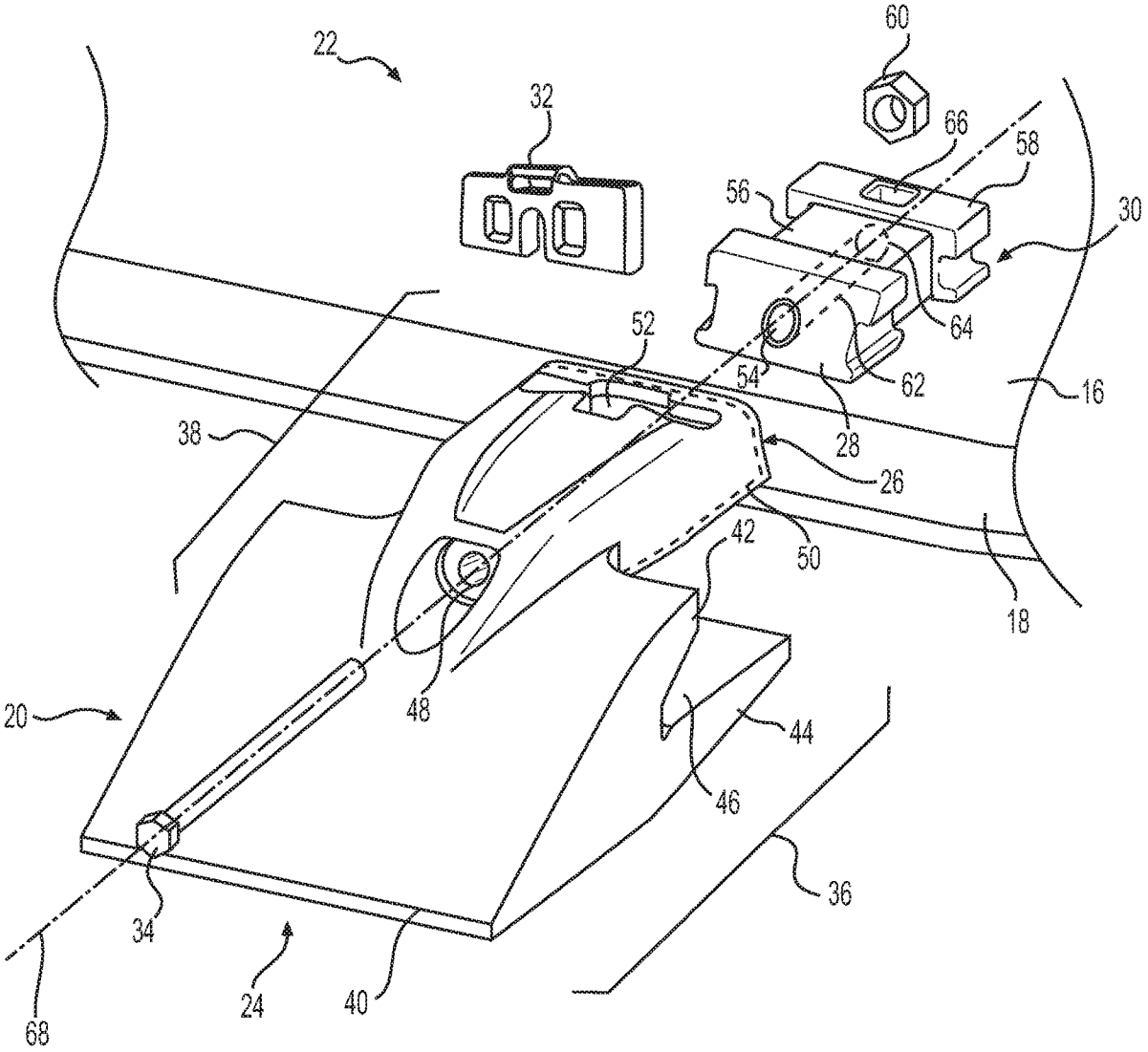
FIG. 2 is an illustration of an exemplary shroud retention system for the work tool of FIG. 1.

FIG. 2 illustrates an exemplary shroud retention system 22 for attaching shroud 20 to work tool 10. Shroud 20 may extend from adjacent shroud proximal end 24 to adjacent shroud distal end 26. Shroud retention system 22 may include adapter 28, spring assembly 30, retainer plate 32, and bolt 34. Shroud 20 may include tip portion 36 and attachment portion 38. Tip portion 36 may be generally C-shaped and may include tip 40, upper leg 42, and lower leg 44. Upper and lower legs 42 and 44 may extend in a direction away from tip 40 towards shroud distal end 26. Upper leg 42 may be spaced apart from lower leg 44, forming opening 46 between upper and lower legs 42, 44. Opening 46 may be large enough to receive edge 18 of work tool 10. Attachment portion 38 may be attached to upper leg 42 of tip portion 36. Like upper and lower legs 42, 44, attachment portion 38 may extend in a direction away from tip 40 towards shroud distal end 26. Attachment portion 38 may include hole 48 configured to receive bolt 34. Attachment portion 38 may also include channel 50 (see dashed lines). Attachment portion 38 may include elongated opening 52 configured to slidably receive retainer plate 32. In one exemplary embodiment as illustrated in FIG. 2, attachment portion 38 may have a width that may be smaller than a width of tip 40.

Adapter 28 may be attached to primary wall 16 of work tool 10. In one exemplary embodiment, adapter 28 may be fixedly attached to primary wall 16 by welding, brazing, etc. In another exemplary embodiment, adapter 28 may be removably attached to primary wall 16 via one or more fasteners (not shown). Adapter 28 may be configured to be slidably received in attachment portion 38. Adapter 28 may include hole 54 configured to receive bolt 34. Spring assembly 30 may be disposed adjacent adapter 28. Spring assembly 30 may be attached to adapter 28 and may include resilient member 56, slide compressor 58, and nut 60. As illustrated in FIG. 2, resilient member 56 may be disposed between adapter 28 and slide compressor 58. Resilient member 56 may include hole 62 configured to receive bolt 34. Slide compressor 58 may be configured to be slidably received in attachment portion 38. Slide compressor 58 may include hole 64 configured to receive bolt 34. Slide compressor 58 may also include slot 66 which may be configured to receive nut 60. Bolt 34 may pass through hole 48 in attachment portion 38 of shroud 20, hole 54 in adapter 28, hole 62 in resilient member 56, and hole 64 in slide compressor 58 to threadingly engage with nut 60 disposed within slot 66. In an assembled condition, bolt 34 and holes 48, 54, 62, and 64 may share a common longitudinal axis 68. Slide compressor 58 may be configured to slidably movable within channel 50 and along longitudinal axis 68 relative to adapter 28. For example, slide compressor 58 may be configured to slidably move towards adapter 28, along longitudinal axis 68, when bolt 34 is turned to engage with nut 60, compressing resilient member 56 disposed between adapter 28 and slide compressor 58. Turning bolt 34 in an opposite direction may cause slide compressor 58 to slidably move away from adapter 28 along longitudinal axis 68.

Figure 3:
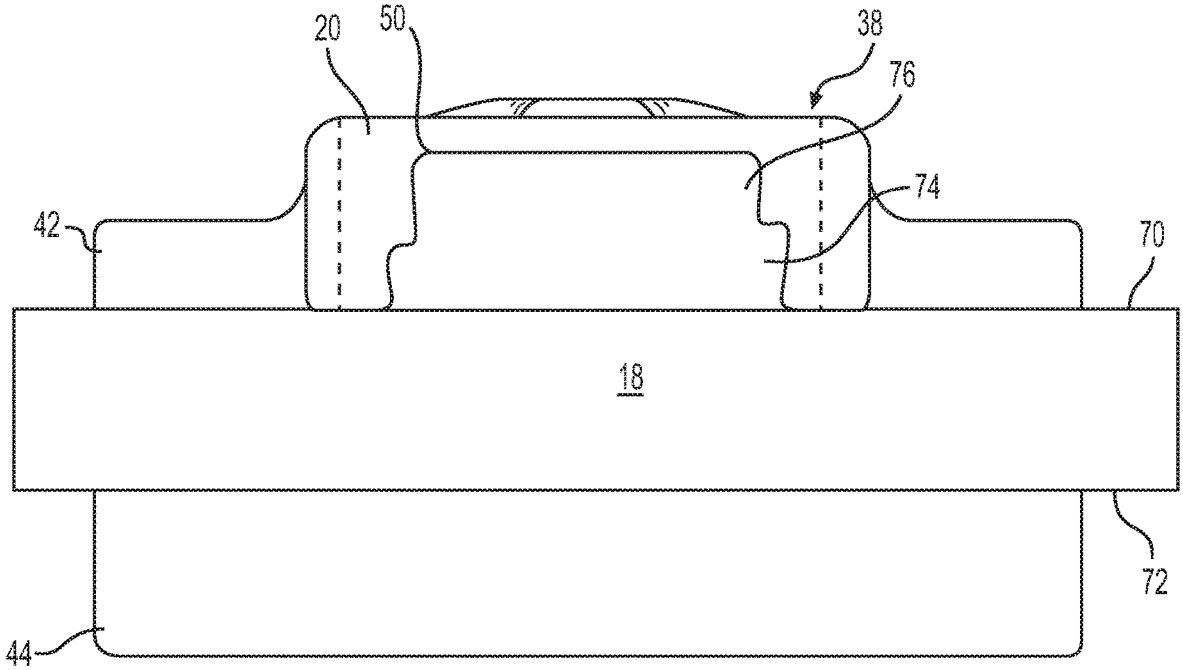
FIG. 3 is rear view of the exemplary shroud of FIG. 2.

FIG. 3 illustrates a rear view of shroud 20 as assembled on edge 18 of work tool 10. As illustrated in FIG. 3, upper leg 42 of shroud 20 may abut on upper surface 70 of edge 18, and lower leg 44 of shroud 20 may abut on lower surface 72 of edge 18. In one exemplary embodiment as shown in FIG. 3, channel 50 in attachment portion 38 may have a generally inverted U-shape and may be configured to slidably engage with adapter 28. Although FIG. 3 illustrates a channel having two generally trapezoidal recesses 74 and 76, having slightly different shapes and sizes, the cross-sectional shape of channel 50 is not limited to the illustrated shapes. For example, in some exemplary embodiments, channel 50 may be an inverter U-shaped channel including a single recess having a width about equal to that of recess 74 or recess 76. Adapter 28 and slide compressor 58 may be shaped so as be slidingly received within channel 50. The shapes and sizes of channel 50 (including recesses 74 and 76), adapter 28, and slide compressor 58 may be selected so that shroud 20 may be slidable onto adapter 28 and slide compressor 58 while minimizing lateral movement of shroud 20 relative to adapter 28 and compressor block 80.

Figure 4:
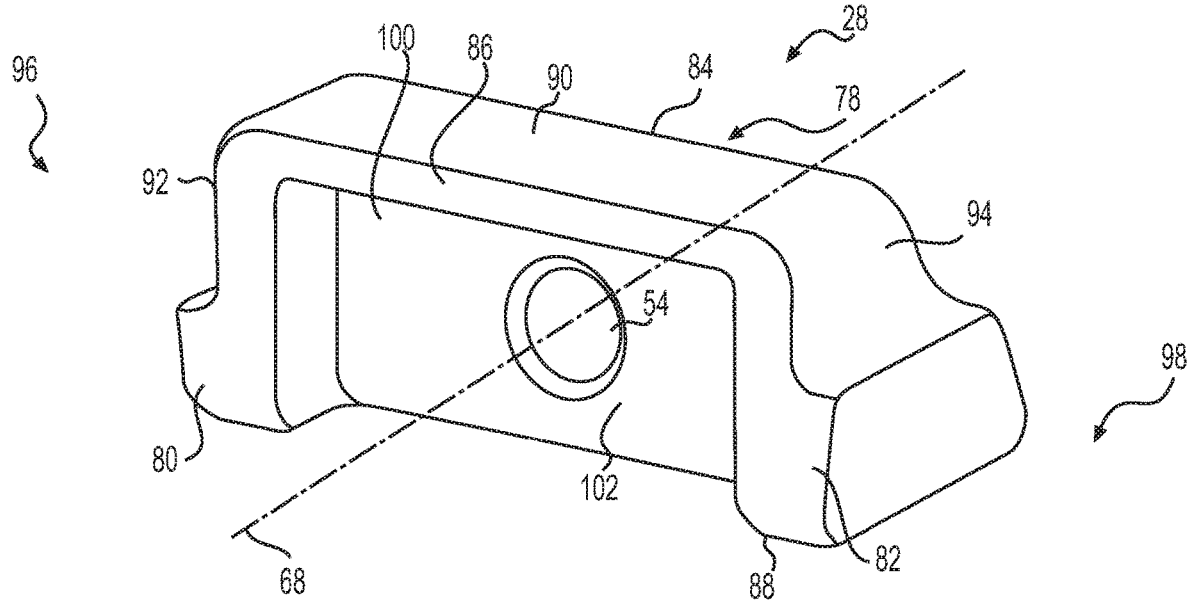
FIG. 4 is a perspective view of an exemplary adapter for the shroud retention system of FIG. 2.

FIG. 4 illustrates a perspective view of an exemplary disclosed adapter 28. Adapter 28 may include adapter block 78, first protrusion 80, and second protrusion 82. Adapter block 78 may include adapter front face 84 and adapter rear face 86 disposed opposite adapter front face 84. Adapter rear face 86 may be spaced apart from adapter front face 84. Adapter block 78 may include adapter bottom face 88 that may extend from adapter front face 84 to adapter rear face 86. Adapter bottom face 88 may be configured to abut against upper surface 70 of work tool 10. Adapter block 78 may include adapter top face 90 that may extend from adapter front face 84 to adapter rear face 86. Adapter top face 90 may be disposed opposite adapter bottom face 88. In one exemplary embodiment as illustrated in FIG. 4, adapter rear face 86 may be disposed generally perpendicular to longitudinal axis 68, adapter bottom face 88 may be disposed generally perpendicular to adapter rear face 86, and adapter rear face 86 may be disposed generally perpendicular to adapter bottom face 88 and adapter top face 90. As used in this disclosure, the terms "about" and "generally" indicate typical manufacturing tolerances and dimensional rounding. For example, two surfaces that are generally perpendicular may be disposed at angles of about 90±1° relative to each other.

Adapter 28 may include first adapter side wall 92 and second adapter side wall 94. First adapter side wall 92 may be disposed on first side 96 of adapter 28 and may extend from adapter front face 84 to adapter rear face 86. Second adapter side wall 94 may be disposed on second side 98 of adapter 28 opposite first side 96. Second adapter side wall 94 may also extend from adapter front face 84 to adapter rear face 86. First and second adapter side walls 92, 94 may be disposed generally perpendicular to adapter front face 84, adapter rear face 86, adapter bottom face 88, and adapter top face 90.

First protrusion 80 may extend outward from adapter block 78. First protrusion 80 may be disposed generally perpendicular to first adapter side wall 92. Second protrusion 82 may be disposed opposite first protrusion 80 and may extend outward from adapter block 78. Second protrusion 82 may be disposed generally perpendicular to second adapter side wall 94. First and second protrusions 80, 82 may be sized to be slidably received in recess 74 of shroud 20. In one exemplary embodiment, first and second protrusions 80, 82 may form a dovetail mortice shape, which may be slidably received in recess 74 of channel 50. Likewise, adapter block 78 may form a dovetail mortice shape, which may be slidably received in recess 76 of channel 50.

Adapter 28 may include recess 100, which may extend from adapter rear face 86 into adapter block 78 towards adapter front face 84. Recess 100 may have a recess base 102, which may be disposed generally parallel to adapter rear face 86. Recess 100 may have a depth that may be smaller than a thickness of adapter 28. A size of recess 100 may be selected such that one end of resilient member 56 may be slidably retained within recess 100. Although recess 100 has been illustrated in FIG. 4 as having a generally rectangular shape, other shapes of recess 100 are also contemplated. Hole 54 of adapter 28 may extend from recess base 102 to adapter front face 84. In one exemplary embodiment as illustrated in FIG. 4, hole 54 may be a through hole and may have a generally circular cross-section. It is contemplated, however, that in some exemplary embodiments, hole 54 may be tapped to threadingly receive bolt 34.

Figure 5:
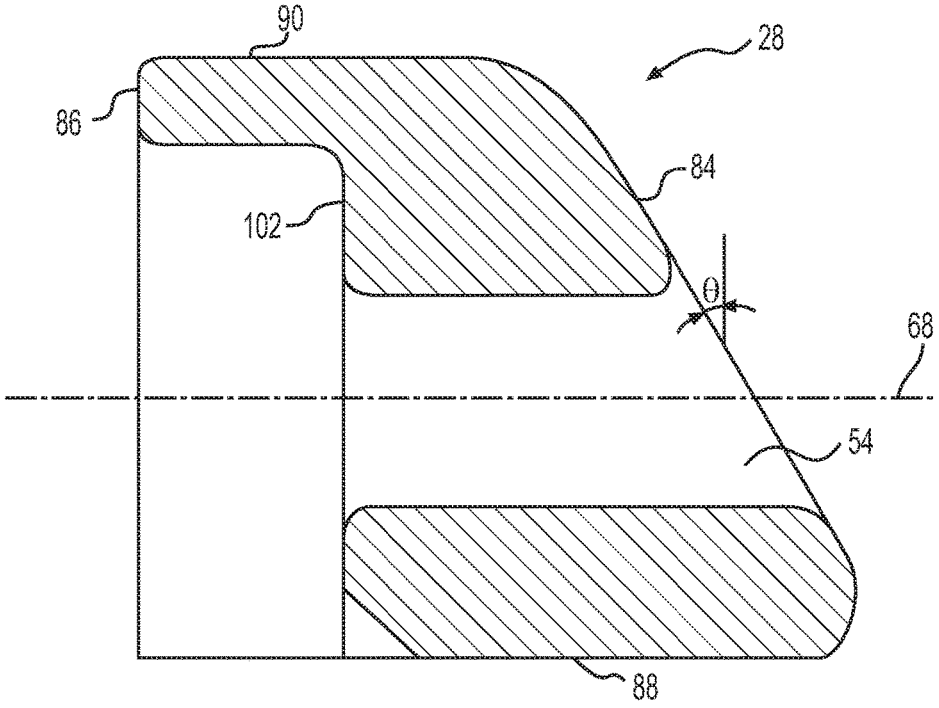
FIG. 5 is a cross-sectional view of the exemplary adapter of FIG. 4.

FIG. 5 illustrates a vertical cross-sectional view of adapter 28 on a plane passing through longitudinal axis 68. As illustrated in FIG. 5, adapter front face 84 may be generally inclined relative to adapter bottom face 88, adapter top face 90, adapter rear face 86, and recess base 102. In one exemplary embodiment, adapter front face 84 may be inclined towards adapter rear face 86 so that a thickness of adapter 28 adjacent adapter top face 90 may be smaller than a thickness of adapter 28 adjacent adapter bottom face 88. Angle of inclination θ of adapter front face 84 relative to a vertical plane disposed generally parallel to adapter rear face 86 may range between about 15° to 30°.

Figure 6:
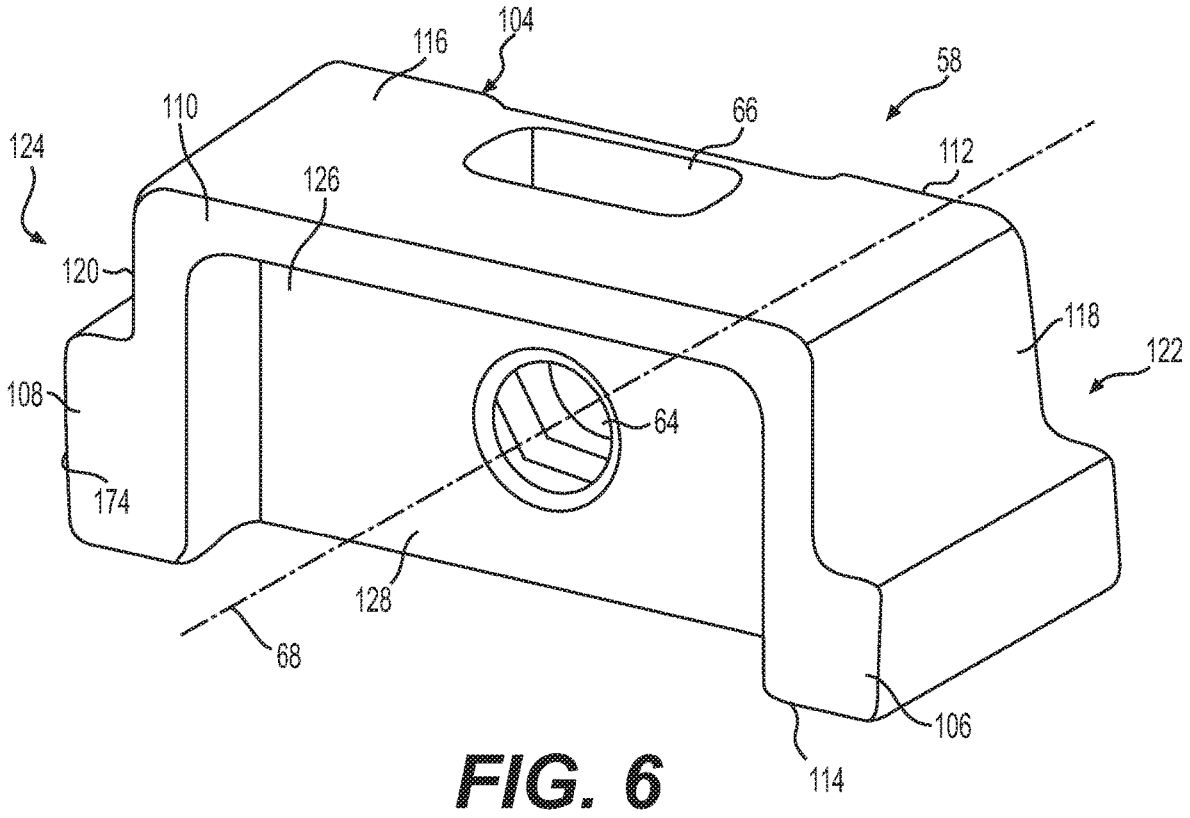
FIG. 6 is a perspective view of an exemplary compressor block for the shroud retention system of FIG. 2.

FIG. 6 illustrates a perspective view of an exemplary disclosed slide compressor 58. Slide compressor 58 may include compressor block 104, first protrusion 106, and second protrusion 108. Compressor block 104 may include compressor front face 110 and compressor rear face 112 disposed opposite compressor front face 110. Compressor front face 110 may be disposed generally perpendicular to longitudinal axis 68. Compressor rear face 112 may be spaced apart from compressor front face 110. Compressor block 104 may include compressor bottom face 114 that may extend from compressor front face 110 to compressor rear face 112. Compressor bottom face 114 may be configured to slidably engage with upper surface 70 of work tool 10. Compressor block 104 may include compressor top face 116 that may extend from compressor front face 110 to compressor rear face 112. Compressor top face 116 may be disposed opposite compressor bottom face 114. Compressor front face 110 may be disposed generally perpendicular to compressor bottom face 114 and compressor top face 116.

Compressor block 104 may include first compressor side wall 118 and second compressor side wall 120 disposed opposite first compressor side wall 118. First compressor side wall 118 may be disposed on first side 122 of compressor block 104 and may extend from compressor front face 110 to compressor rear face 112. Second compressor side wall 120 may be disposed on second side 124 of compressor block 104 opposite first side 122. Second compressor side wall 120 may extend from compressor front face 110 to compressor rear face 112. First and second compressor side walls 118, 120 may be disposed generally perpendicular to compressor front face 110, compressor rear face 112, compressor bottom face 114, and compressor top face 116.

First protrusion 106 may extend outward from compressor block 104. First protrusion 106 may be disposed generally perpendicular to first compressor side wall 118. Second protrusion 108 may be disposed opposite first protrusion 106 and may extend outward from compressor block 104. Second protrusion 108 may be disposed generally perpendicular to second compressor side wall 120. First and second protrusions 106, 108 may form a dovetail mortice shape, which may be slidably received in recess 74 of channel 50. Compressor block 104 may form a dovetail mortice shape, which may be slidably received in recess 76 of channel 50.

Slide compressor 58 may include recess 126, which may extend from compressor front face 110 into compressor block 104 towards compressor rear face 112. Recess 126 may have a recess base 128, which may be disposed generally parallel to compressor front face 110. A size of recess 126 may be selected such that one end of resilient member 56 may be slidably retained within recess 126. Although recess 126 has been illustrated in FIG. 6 as having a generally rectangular shape, other shapes of recess 126 are also contemplated. Hole 64 of slide compressor 58 may extend from recess base 128 to compressor rear face 112.

Slot 66 of slide compressor 58 may extend from compressor top face 116 towards compressor bottom face 114 and may intersect with hole 64. Slot 66 may be disposed nearer compressor rear face 112 relative to compressor front face 110. In one exemplary embodiment as illustrated in FIG. 6, slot 66 may have a generally rectangular cross-section. Slot 66 may have a width, which may be selected such that nut 60 may be receivable within slot 66.

Figure 7:
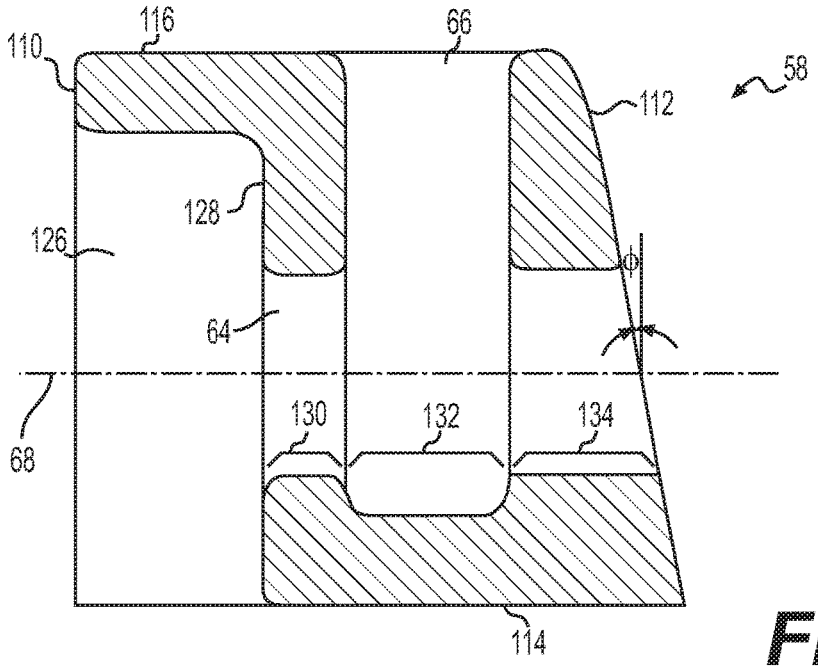
FIG. 7 is a cross-sectional view of the exemplary compressor block of FIG. 6.

FIG. 7 illustrates a vertical cross-sectional view of slide compressor 58 on a plane passing through longitudinal axis 68. As illustrated in FIG. 7, compressor front face 110 may be generally inclined relative to compressor bottom face 114, compressor top face 116, compressor rear face 112, and recess base 128. In one exemplary embodiment, compressor front face 110 may be inclined towards compressor rear face 112 so that a thickness of slide compressor 58 adjacent compressor top face 116 may be smaller than a thickness of slide compressor 58 adjacent compressor bottom face 114. Angle of inclination $\phi$ of compressor front face 110 relative to a vertical plane disposed generally parallel to compressor rear face 112 may range between about 15° to 30°.

As also illustrated in FIG. 7, hole 64 may have a first hole portion 130, a second hole portion 132, and a third hole portion 134. First hole portion 130 may extend from recess base 128 to slot 66. Second hole portion 132 may be a portion of hole 64 that intersects with slot 66. Third hole portion 134 may extend from slot 66 to compressor rear face 112. First and third hole portions 130 and 134 may have a generally circular cross-sections while second hole portion 132 may have a generally non-circular cross-section. Slot 66 may intersect with second hole portion 132, which may be configured to slidably receive nut 60 through slot 66. The non-circular cross-section of second hole portion 132 may help prevent rotation of nut 60 within second hole portion 132.

Figure 8:
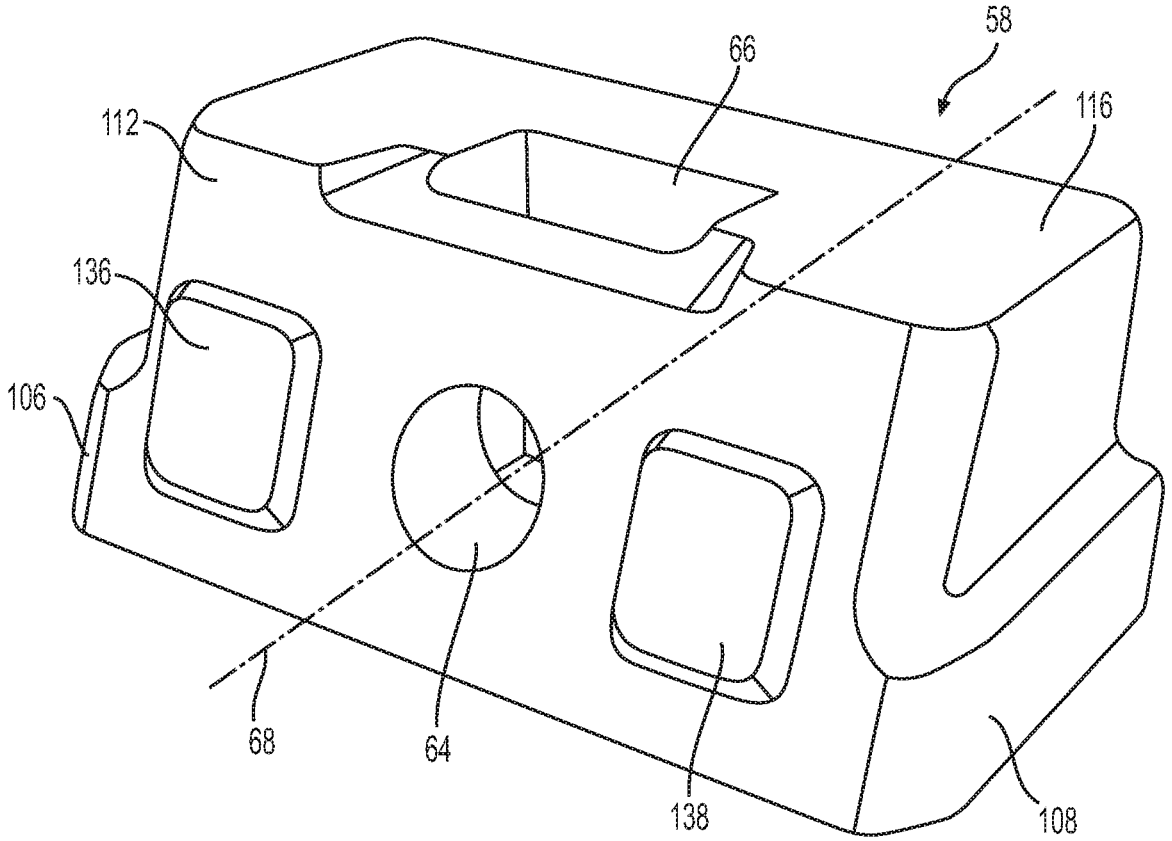
FIG. 8 is another perspective view of the exemplary compressor block of FIG. 6.

FIG. 8 illustrates another perspective view of slide compressor 58. As illustrated in FIG. 8, slide compressor 58 may include one or more compressor mating features 136, 138 disposed on compressor rear face 112. For example, as shown in FIG. 8, slide compressor 58 may include two compressor mating features 136, 138, which may be disposed on opposite sides of hole 64. It is contemplated that slide compressor 58 may include only one of compressor mating feature 136 or 138. It is also contemplated that when slide compressor 58 includes two compressor mating features, both compressor mating features 136, 138 may be disposed on the same side of hole 64. It is further contemplated that more than one compressor mating feature 136 or 138 may be present on either side of hole 64 on compressor rear face Furthermore, compressor mating features 136, 138 may be disposed symmetrically or asymmetrically about longitudinal axis 68. That is, respective distances between compressor mating features 136, 138 and longitudinal axis 68 may be equal or unequal.

Compressor mating features 136, 138 may include protrusions or recesses. For example, as illustrated in FIG. 8, compressor mating features 136, 138 may include protrusions, which may extend outward from compressor rear face 112. Protrusions 136, 138 may extend generally perpendicular to compressor rear face 112. It is contemplated, however, that in some exemplary embodiments, protrusions 136, 138 may not be orthogonal to compressor rear face 112. It is further contemplated that in some embodiments, only a portion of protrusions 136, 138 may be disposed generally perpendicular to compressor rear face 112. Protrusions 136, 138 may have a generally rectangular shape. It is contemplated, however, that protrusions 136, 138 may have a square shape, circular shape, elliptical shape, polygonal shape, cross shape, or any other type of shape known in the art. Protrusions 136 and 138 may protrude to the same or different heights relative to compressor rear face 112. In one exemplary embodiment as illustrated in FIG. 8, protrusions 136 and 138 may be disposed generally symmetrically about hole 64. It is contemplated, however, that protrusions 136 and 138 may be disposed asymmetrically about hole 64 so that distances of protrusions 136 and 138 from longitudinal axis 68 may be different.

Figure 9:
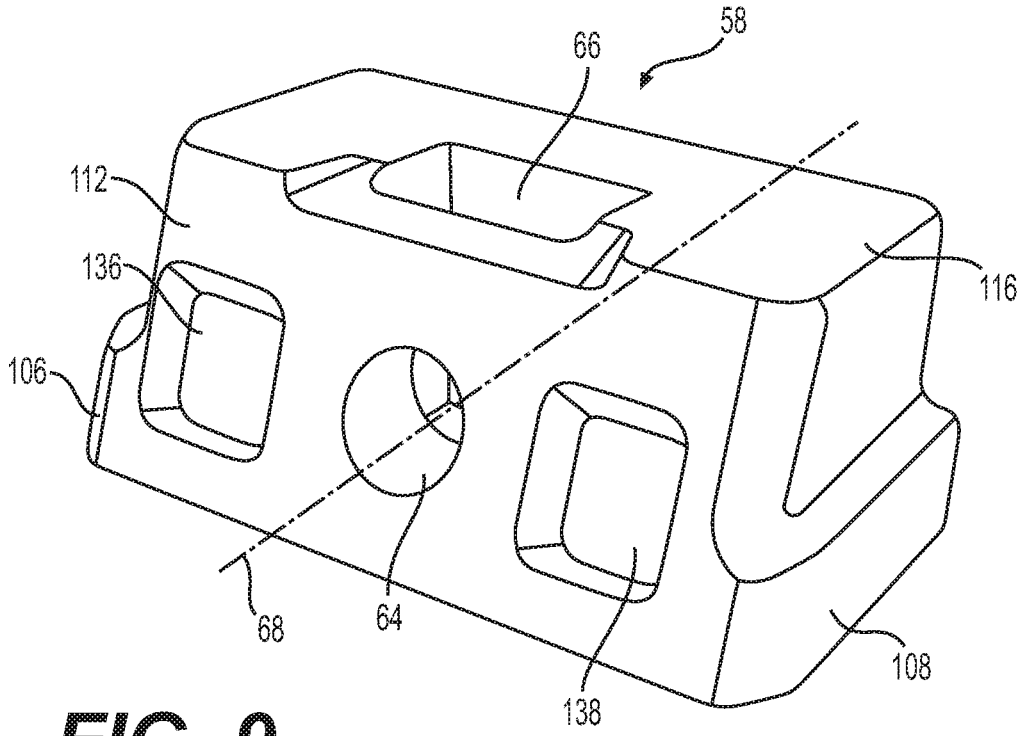
FIG. 9 is a perspective view of another exemplary embodiment of the compressor block of FIG. 6.

FIG. 9 illustrates another exemplary embodiment of slide compressor 58. In this exemplary embodiment, compressor mating features 136, 138 may include recesses that may extend inward from compressor rear face 112 into slide compressor 58. Recesses 136, 138 may extend generally perpendicular to compressor rear face 112. It is contemplated, however, that in some exemplary embodiments, recesses 136, 138 may not be orthogonal to compressor rear face 112. It is further contemplated that in some embodiments, only a portion of recesses 136, 138 may be disposed generally orthogonally to compressor rear face 112. Recesses 136, 138 may have a generally rectangular shape. It is contemplated, however, that recesses 136, 138 may have a square shape, circular shape, elliptical shape, polygonal shape, cross shape, or any other type of shape known in the art. Recesses 136 and 138 may extend into compressor block to the same or different depths relative to compressor rear face 112. In one exemplary embodiment as illustrated in FIG. 8, recesses 136 and 138 may be disposed generally symmetrically about hole 64. It is contemplated, however, that recesses 136 and 138 may be disposed asymmetrically about hole 64 so that the distances of recesses 136 and 138 from longitudinal axis 68 may be different.

Figure 10:
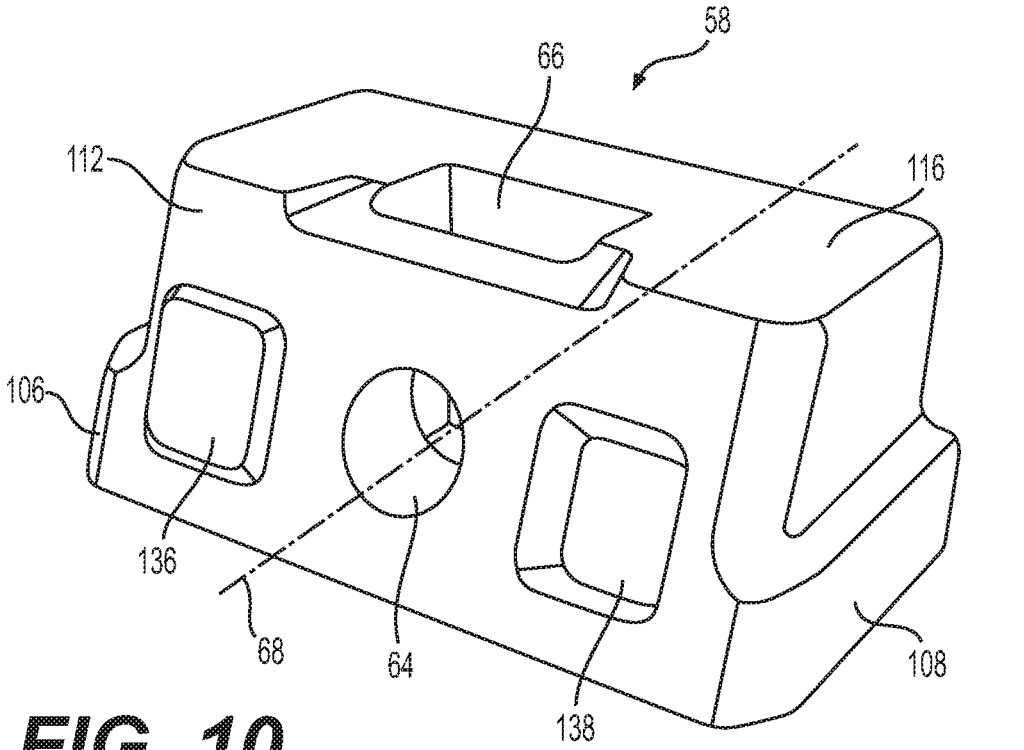
FIG. 10 is a perspective view of yet another exemplary embodiment of the compressor block of FIG. 6.

FIG. 10 illustrates yet another exemplary embodiment of slide compressor 58. In this exemplary embodiment, compressor mating features 136 may include a protrusion and compressor mating feature 138 may include a recess, or vice-versa. When compressor mating feature 136 or 138 includes a protrusion, compressor mating feature 136 or 138 may have a structure and function similar to that of one or more of protrusions 136, 138 discussed above with respect to the embodiment of slide compressor 58 of FIG. 8. Similarly, when compressor mating feature 136 or 138 includes a recess, compressor mating feature 136 or 138 may have a structure and function similar to that of one or more recesses 136, 138 discussed above with respect to the embodiment of slide compressor 58 of FIG. 9 discussed above.

Figure 11:
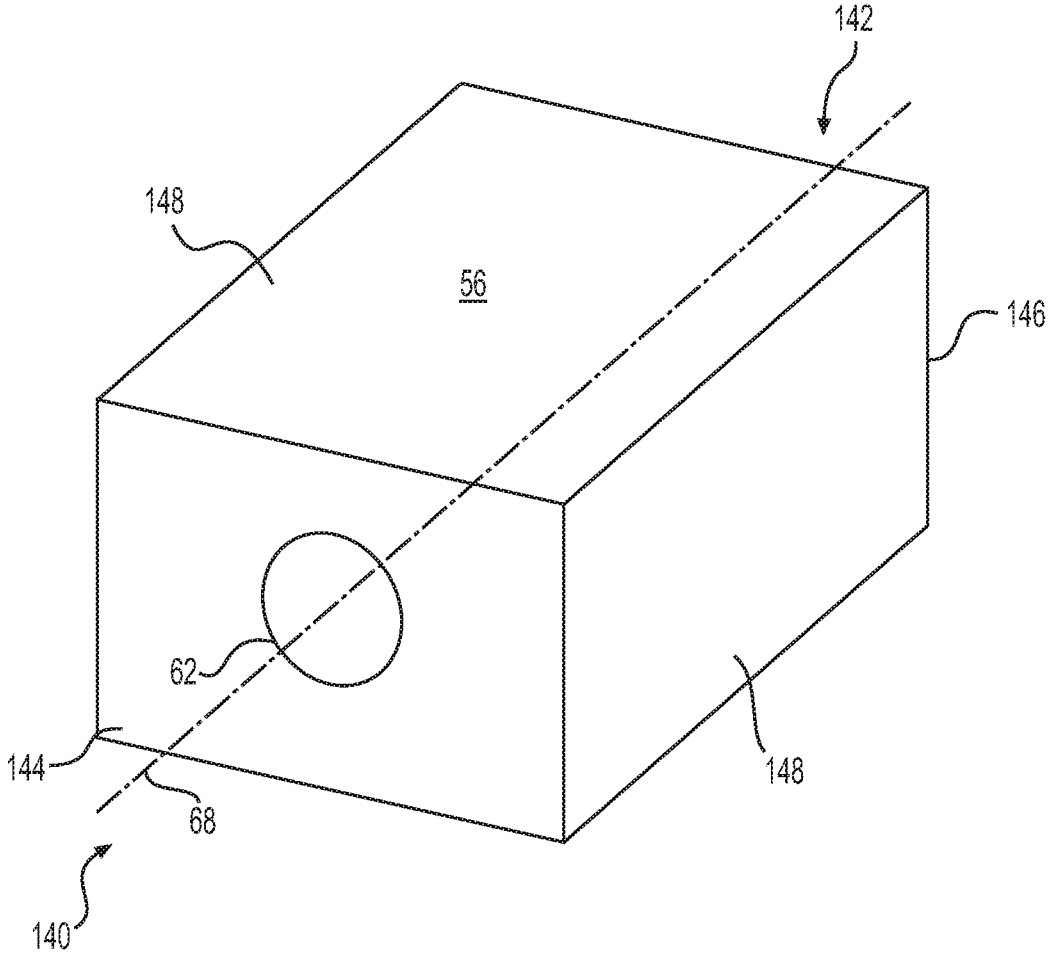
FIG. 11 is a perspective view of an exemplary resilient member for the shroud retention system of FIG. 2.

FIG. 11 illustrates a perspective view of an exemplary disclosed resilient member 56. In one exemplary embodiment as illustrated in FIG. 11, resilient member 56 may have a generally cuboidal shape. It is contemplated, however, that resilient member 56 may have a cylindrical, conical, ellipsoidal, frusto-conical, or any other shape known in the art. Resilient member 56 may be configured to be disposed between adapter 28 and slide compressor 58. Resilient member 56 may extend from damper proximal end 140 to damper distal end 142. Resilient member 56 may be configured to be slidably attached to adapter 28 adjacent damper proximal end 140. Likewise, resilient member 56 may be configured to be slidably attached to slide compressor 58 adjacent damper distal end 142.

Resilient member 56 may include damper front face 144, damper rear face 146, and damper sides 148. Damper front face 144 may be disposed adjacent damper proximal end 140. Damper rear face 146 may be disposed opposite and spaced apart from damper front face 144. Damper rear face 146 may be disposed adjacent damper distal end 142. Damper sides 148 may extend from damper front face 144 to damper rear face 146. Damper front face 144 may be disposed generally parallel to damper rear face 146. Damper sides 148 may be disposed generally orthogonal to damper front face 144 and damper rear face 146.

Damper front face 144 may have a generally rectangular shape, although other shapes are also contemplated. A size and shape of damper front face 144 may be selected so that damper front face 144 may be receivable in recess 100 of adapter 28. Damper front face 144 may be configured to abut against recess base 102 of recess 100. Damper rear face 146 may have a generally rectangular shape, although other shapes are also contemplated. A size and shape of damper rear face 146 may be selected so that damper rear face 146 may be receivable in recess 126 of slide compressor 58. Damper rear face 146 may be configured to abut against recess base 128 of recess 126.

Resilient member 56 may include hole 62, which may extend from damper front face 144 to damper rear face 146. Hole 62 may be a through hole. It is also contemplated that in some embodiments, hole 62 may be tapped to threadingly receive bolt 34. Resilient member 56 may be made of elastomeric material, which may be configured to be compressed between adapter 28 and slide compressor 58. Additionally, or alternatively, resilient member 56 may include one or more spring members (not shown) disposed between damper front face 144 and damper rear face 146.

Figure 12:
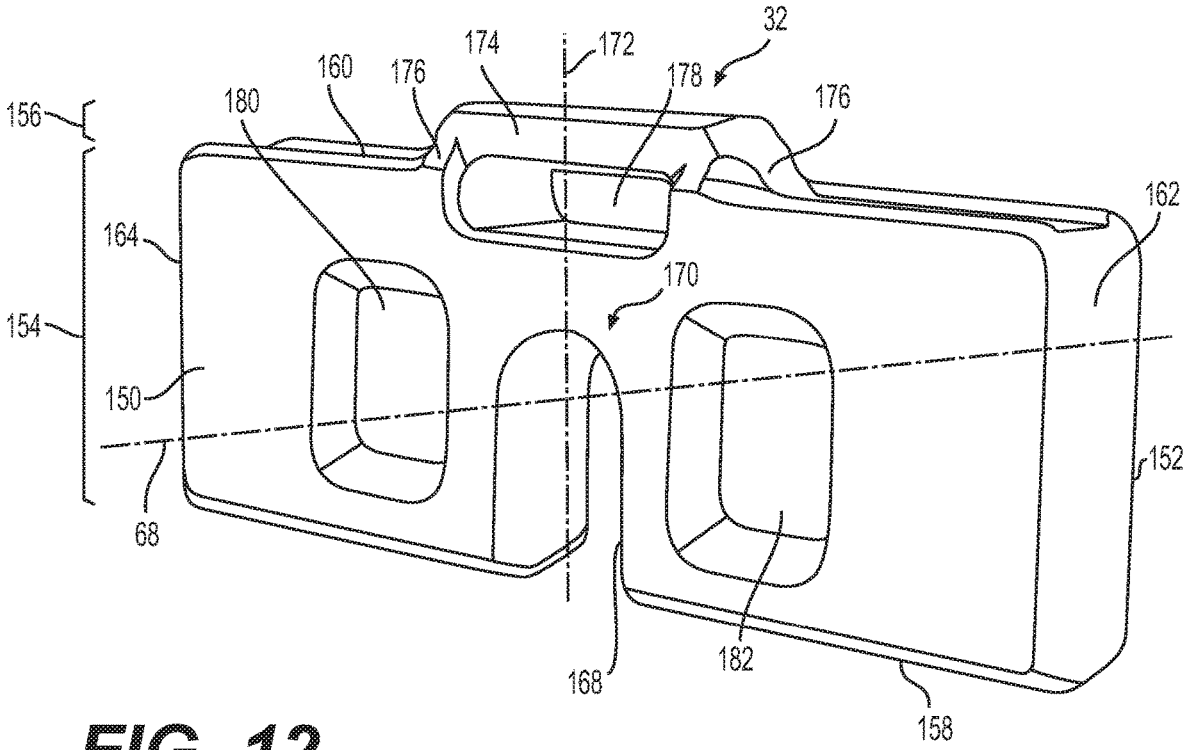
FIG. 12 is a perspective view of an exemplary retainer plate for the shroud retention system of FIG. 2.

FIG. 12 illustrates a perspective view of an exemplary disclosed retainer plate 32. Retainer plate 32 may have a retainer front face 150 disposed opposite retainer rear face 152. Retainer front and rear faces 150, 152 may be disposed generally parallel to each other and may be separated by a thickness of retainer plate 32. In one exemplary embodiment as illustrated in FIG. 11, the thickness may be generally uniform over an area of retainer front and rear faces 150, 152.

Retainer plate 32 may include retainer portion 154 and handle portion 156. Retainer portion 154 may have a generally rectangular shape and may include retainer bottom face 158, retainer top face 160, first retainer side face 162, and second retainer side face 164. Retainer bottom face 158 may extend from retainer front face 150 to retainer rear face 152. Retainer top face 160 may extend from retainer front face 150 to retainer rear face 152. Retainer top face 160 may be disposed generally orthogonal to retainer front and rear faces 150, 152. First retainer side face 162 may extend from retainer front face 150 to retainer rear face 152 and between retainer bottom face 158 and retainer top face 160. First retainer side face 162 may be disposed generally orthogonal to retainer front and retainer rear faces 150, 152, respectively, and orthogonal to retainer top face 160. Likewise, second retainer side face 164 may extend from retainer front face 150 to retainer rear face 152 and extend between retainer bottom face 158 and retainer top face 160. Second retainer side face 164 may be disposed generally orthogonal to retainer front and retainer rear faces 150, 152, respectively, and orthogonal to retainer top face 160. It is contemplated, however, that retainer front face 150, retainer rear face 152, retainer bottom face 158, retainer top face 160, first retainer side face 162, and second retainer side face 164 may be disposed generally inclined relative to one or more of each other.

Retainer portion 154 may include slot 168, which may extend through the thickness from retainer front face 150 to retainer rear face 152. In one exemplary embodiment as illustrated in FIG. 11, slot 168 may be disposed generally midway between first and second retainer side faces 162 and 164. Slot 168 may extend from retainer bottom face 158 toward retainer top face 160 to slot end 170, which may be disposed between retainer bottom face 158 and retainer top face 160. Slot 168 may be symmetrically disposed about slot axis 172, which may form an axis of symmetry of slot 168. Slot axis 172 may be disposed generally perpendicular to longitudinal axis 68. In one exemplary embodiment as illustrated in FIG. 12, slot axis 172 may intersect longitudinal axis 68. A width of slot 168 may be selected to be larger than a diameter of bolt 34.

Handle portion 156 may extend outward from retainer top face 160 of retainer portion 154. Handle portion 156 may be disposed generally midway between first and second retainer side faces 162, 164 of retainer portion 154. Handle portion 156 may include a handle 174, which may be disposed generally parallel to retainer top face 160 of retainer portion 154. Handle 174 may be connected to retainer portion 154 by legs 176 disposed spaced apart from each other. Handle 174 may be separated from retainer top face 160 by an opening 178.

Retainer plate 32 may include one or more retainer mating features 180, 182 disposed on retainer front face 150. For example, as shown in FIG. 12, retainer portion 154 may include two retainer mating features 180, 182, which are disposed on opposite sides of slot 168. It is contemplated that retainer portion 154 may include only one retainer mating feature 180 or 182. It is also contemplated that when retainer portion 154 includes two retainer mating features on retainer front face 150, both retainer mating features 180, 182 may be disposed on the same side of slot 168. It is further contemplated that more than one retainer mating feature 180 or 182 may be present on either side of slot 168 on retainer front face 150. Furthermore, retainer mating features 180, 182 may be disposed symmetrically or asymmetrically about slot axis 172. That is, respective distances between retainer mating features 180, 182 and slot axis 172 may be equal or unequal. Although not visible in FIG. 11, retainer portion 154 of retainer plate 32 may also include one or more retainer mating features 184, 186 disposed on retainer rear face 152 (see FIG. 13). The retainer mating features on retainer rear face 152 may have features similar to those discussed above for retainer mating features 180, 182. It is also contemplated that retainer plate 32 may include one or more of retainer mating features 180, 182, 184, and/or 186. It is further contemplated that one or more of retainer mating features 180, 182, 184, and/or 186 may itself include a plurality of retainer mating features.

Retainer mating features 180, 182, 184, and/or 186 may include protrusions or recesses. For example, as illustrated in FIG. 12, retainer mating features 180, 182 may include recesses, which may extend inward from retainer front face 150 into the thickness of retainer plate 32. Recesses 180 and 182 may extend generally perpendicular to retainer front face 150. It is contemplated, however, that in some exemplary embodiments, recesses 180, 182 may not be orthogonal to retainer front face 150. It is further contemplated that in some embodiments, only a portion of recesses 180, 182 may be disposed generally perpendicular to retainer front face 150. Recesses 180, 182 may have a generally rectangular shape. It is contemplated, however, that recesses 180, 182 may have a square shape, circular shape, elliptical shape, polygonal shape, cross shape, or any other type of shape known in the art. Recesses 180, 182 may extend into the thickness of retainer plate 32 to the same or different depths relative to retainer front face 150. In one exemplary embodiment as illustrated in FIG. 8, recesses 180, 182 may be disposed generally symmetrically about slot axis 172. It is contemplated, however, that recesses 180, 182 may be disposed asymmetrically at different distances from slot axis 172.

Figure 13:
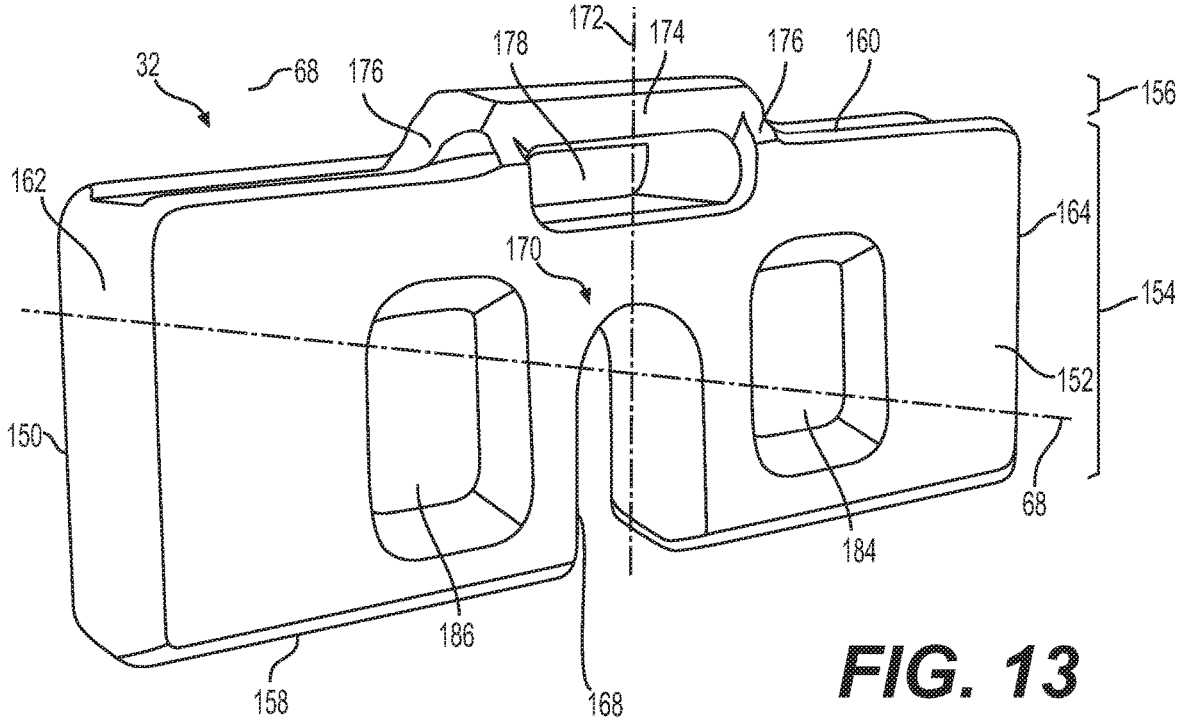
FIG. 13 is another perspective view of the exemplary retainer plate of FIG. 12.
Figure 14:
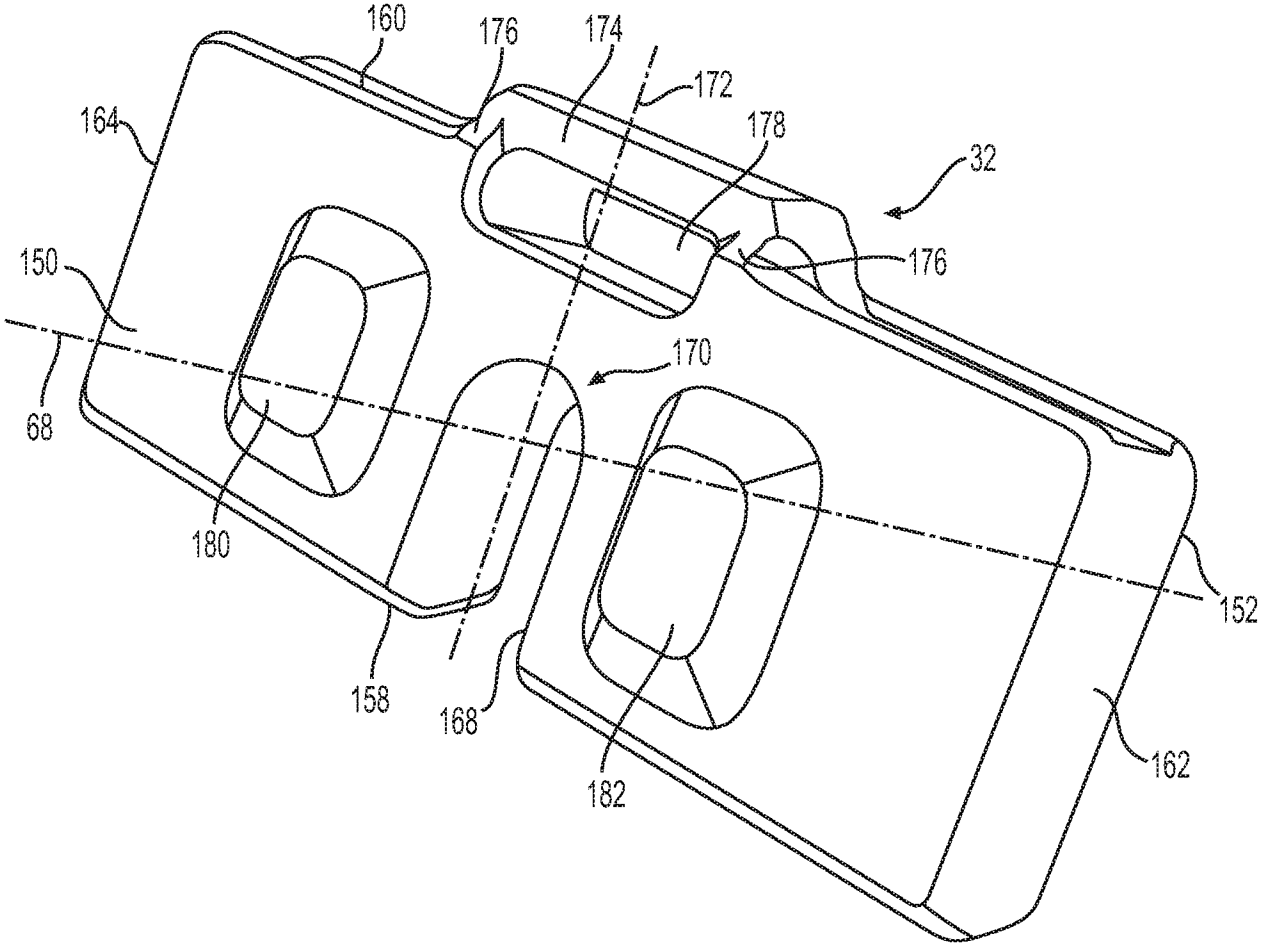
FIG. 14 is a perspective view of another exemplary embodiment of the retainer plate of FIG. 12.

FIG. 14 illustrates another exemplary embodiment of retainer plate 32. In this exemplary embodiment, retainer mating features 180, 182 may include protrusions that may protrude outward from retainer front face 150. Protrusions 180, 182 may extend generally perpendicular to retainer front face 150. It is contemplated, however, that in some exemplary embodiments, protrusions 180 and 182 may not be orthogonal to retainer front face 150. It is further contemplated that in some embodiments, only a portion of protrusions 180, 182 may be disposed generally orthogonally to retainer front face 150. Protrusions 180, 182 may have a generally rectangular shape. It is contemplated, however, that protrusions 180, 182 may have a square shape, circular shape, elliptical shape, polygonal shape, cross shape, or any other type of shape known in the art. Protrusions 180 and 182 may extend outward from retainer plate 32 to the same or different heights relative to retainer front face 150. In one exemplary embodiment as illustrated in FIG. 13, protrusions 180 and 182 may be disposed generally symmetrically about slot axis 172. It is contemplated, however, that protrusions 180 and 182 may be disposed asymmetrically so that the distances of protrusions 180 and 182 from slot axis 172 may be different. Although not visible in FIG. 14, it is contemplated that retainer mating features 184, 186 may also include protrusions that may protrude outward from retainer rear face 152.

Figure 15:
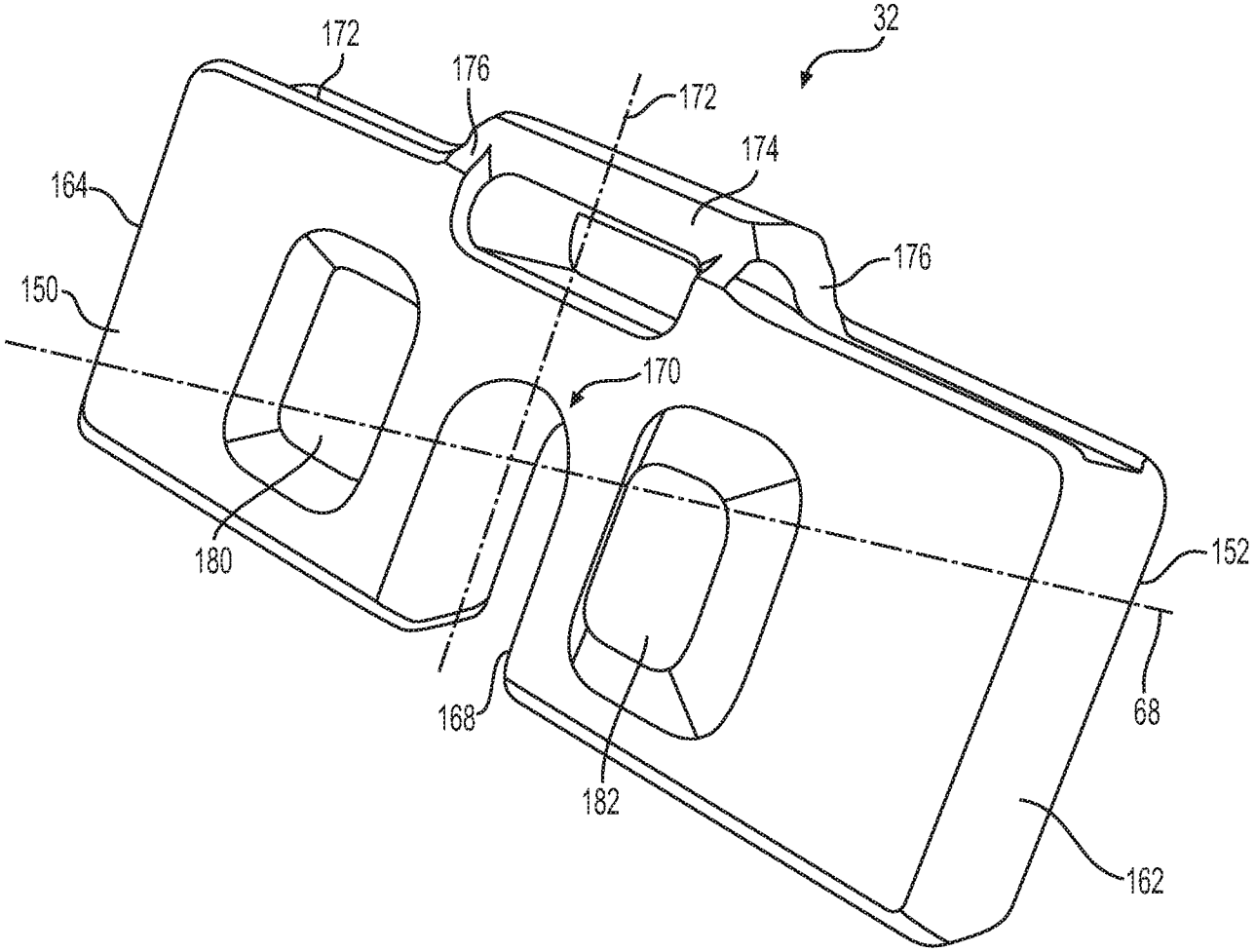
FIG. 15 is a perspective view of yet another exemplary embodiment of the retainer plate of FIG. 12.

FIG. 15 illustrates yet another exemplary embodiment of retainer plate 32. In this exemplary embodiment, retainer mating feature 180 may include a protrusion and retainer mating feature 182 may include a recess, or vice-versa. When retainer mating feature 180 or 182 includes a protrusion, retainer mating feature 180 or 182 may have a structure and function similar to that of one or more of protrusions 180, 182 of FIG. 14 discussed above. Similarly, when retainer mating feature 180 or 182 includes a recess, retainer mating feature 180 or 182 may have a structure and function similar to that of one or more recesses 180, 182 of FIGS. 12 and 13 discussed above. It is further contemplated that any of retainer mating features 180, 182, 184, and/or 186 may include protrusions or recesses.

The one or more compressor mating features 136, 138 of slide compressor 58 may be configured to matingly engage with the one or more retainer mating features 180, 182, respectively, or 184, 186, respectively, of retainer plate 32. For example, when compressor mating features 136 and 138 are protrusions (see FIG. 8), protrusions 136 and 138 may be configured to matingly engage with corresponding recesses 180 and 182 in retainer front face 150, or with corresponding recesses 184 and 186 in retainer rear face 152 of retainer plate 32. In this exemplary embodiment, protrusions 136, 138 may be slidingly received into, for example, recesses 180, 182 to cause protrusions 136, 138 to matingly engage with recesses 180, 182. Similarly, when compressor mating features 136, 138 are recesses (see FIG. 9), recesses 136, 138 may be configured to matingly engage with corresponding protrusions 180 and 182 in retainer front face 150, or with corresponding protrusions 184 and 186 in retainer rear face 152 of retainer plate 32. Engagement of the one or more compressor mating features 136, 138 with retainer mating features 180, 182, or 184, 186 may cause slide compressor 58 and retainer plate 32 to be engaged in a locked condition so that retainer plate 32 is not dislodged and/or disassembled from slide compressor 58 due to vibrations caused during machine operations.

Figure 16:
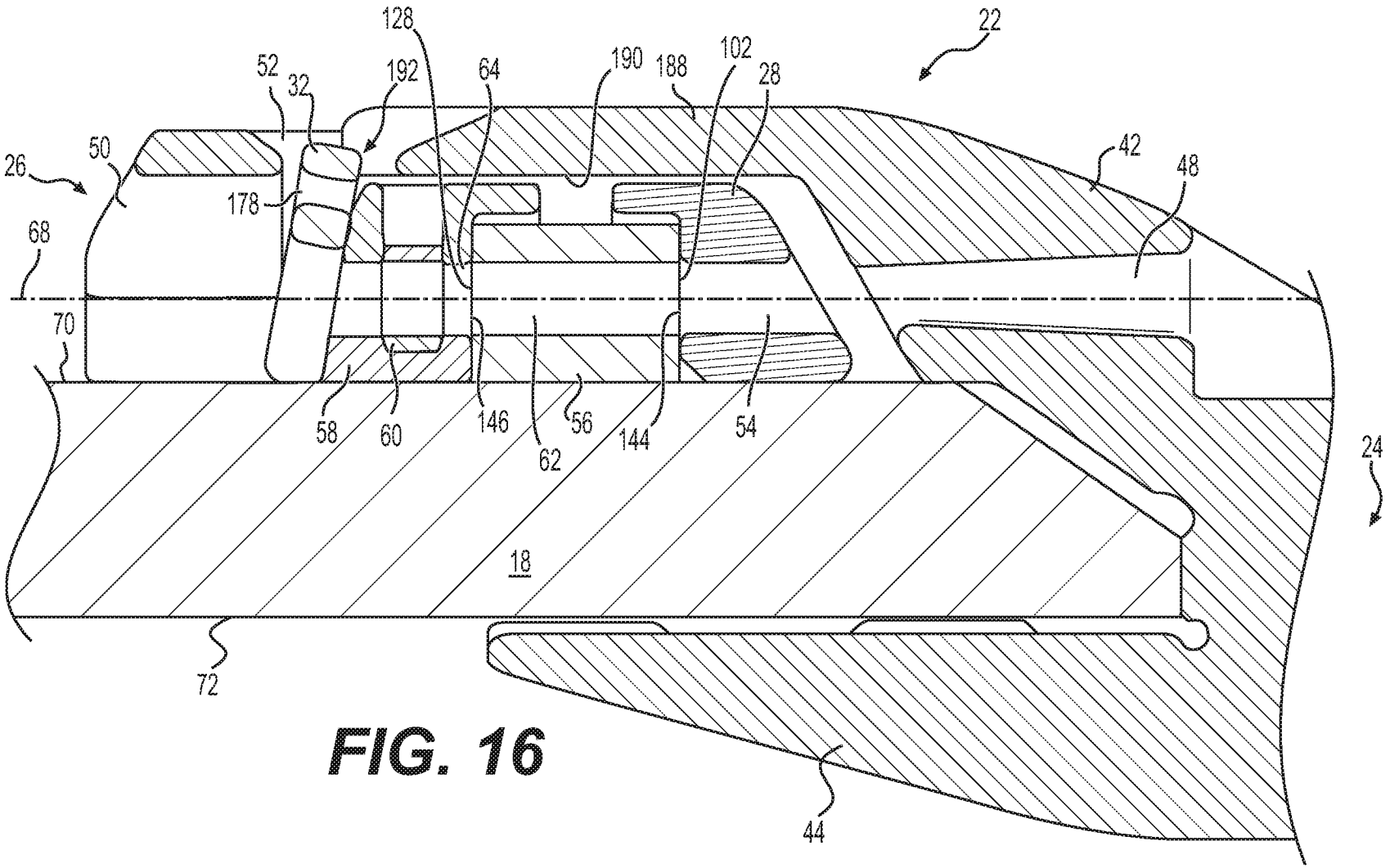
FIG. 16 is a cross-sectional view of the exemplary shroud retention system of FIG. 2.

FIG. 16 illustrates a cross-sectional view of an exemplary disclosed shroud retention system 22 on a plane passing through longitudinal axis 68. As illustrated in FIG. 16, in an assembled configuration, lower leg 44 of shroud 20 may be disposed adjacent lower surface 72 of edge 18 of work tool 10. Upper leg 42 may be disposed adjacent upper surface 70 of edge 18, which may be disposed in opening 46 between upper leg 42 and lower leg 44. Further, adapter 28 may be disposed on upper surface 70 of edge 18. In some exemplary embodiments, adapter 28 may be fixedly attached to edge 18 via welded joints, fasteners, or using any other means of attachment known in the art. Channel 50 of shroud 20 may slidingly engage with adapter 28.

Slide compressor 58 may also be disposed within channel 50, which may slidably engage with slide compressor 58. As illustrated in FIG. 16, resilient member 56 may be disposed between adapter 28 and slide compressor 58 within channel 50. Damper front face 144 of resilient member 56 may be disposed opposite recess base 102 of recess 100 of adapter 28. Damper front face 144 may abut against recess base 102. Damper rear face 146 of resilient member 56 may be disposed opposite recess base 128 of recess 126 of slide compressor 58. Damper rear face 146 may abut against recess base 128. Holes 48, 54, 64, and 66 in shroud 20, adapter 28, resilient member 56, and slide compressor 58, respectively, may be axially aligned with longitudinal axis 68. Nut 60 may be disposed in slot 66 of slide compressor 58, and may be configured to threadingly receive bolt 34. Nut 60 may be disposed within second hole portion 132 of hole 64.

As also illustrated in FIG. 16, retainer plate 32 may be disposed within channel 50 in a locked position. For example, retainer plate 32 may be disposed in channel 50 such that compressor mating features 136, 138 on compressor rear face 112 may matingly engage with retainer mating features 180, 182, respectively (see FIG. 17), on retainer front face 150, causing retainer front face 150 to abut against compressor rear face 112. Top wall 188 of channel 50 may include channel inner surface 190, which may include notch 192. Notch 192 may be disposed adjacent elongated opening 52 in attachment portion 38 of shroud 20. Handle 174 of retainer plate 32 may slidably engage with notch 192.

Figure 17:
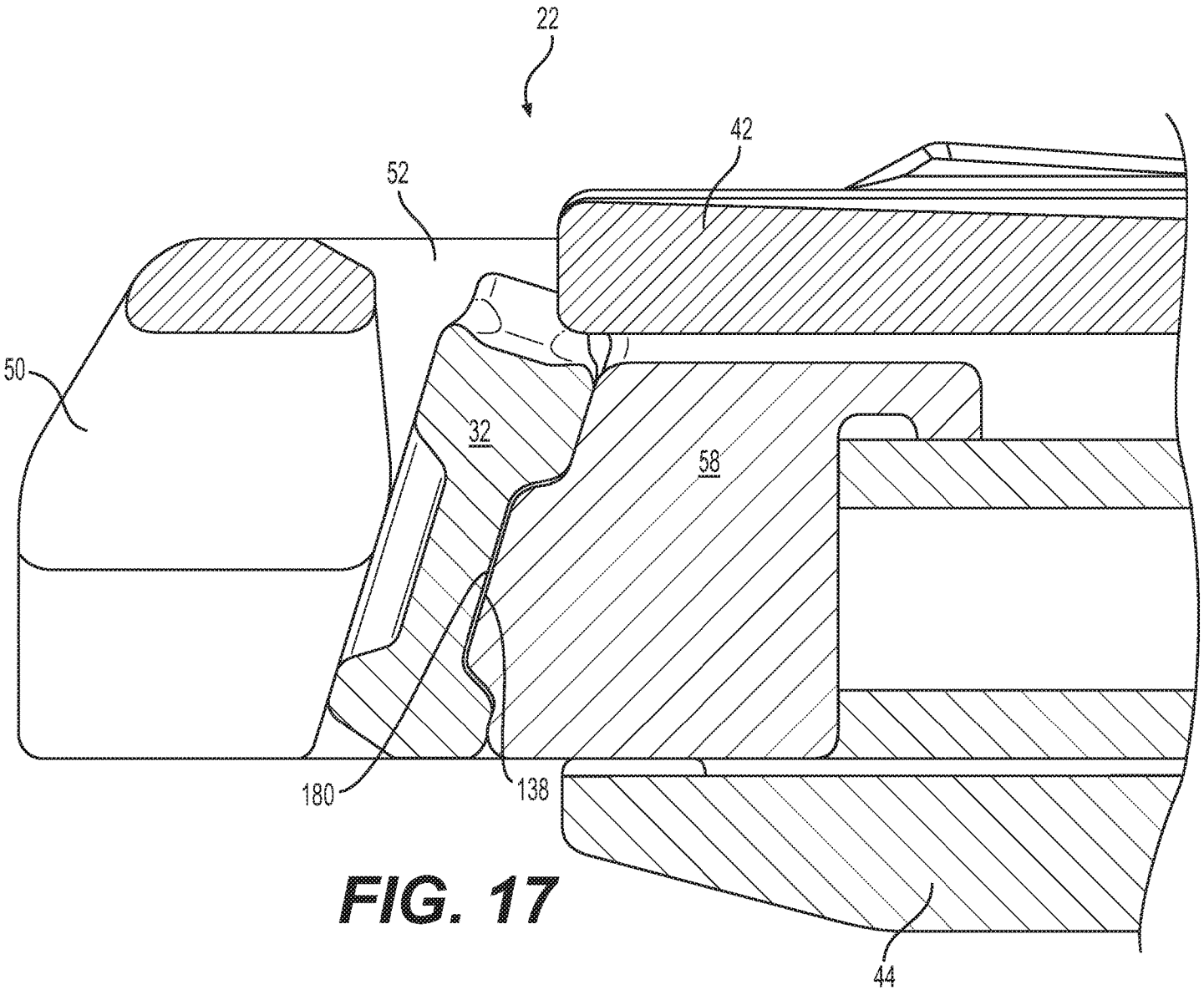
FIG. 17 is another cross-sectional view of the exemplary shroud retention system of FIG. 2.

FIG. 17 illustrates a cross-sectional view of an exemplary disclosed shroud retention system 22 on a vertical plane disposed parallel to longitudinal axis 68 and passing through, for example, compressor mating feature 138 and retainer mating feature 180. As illustrated in the exemplary embodiment of FIG. 17, protrusion 138 (e.g a compressor mating feature) may slidingly enter recess 180 (e.g. retainer mating feature). The assembly of protrusion 138 with recess 180 may allow retainer plate 32 to engage with slide compressor 58 in a locked position in which the protrusion 138 and recess 180 prevent lateral movement of retainer plate 32 relative to slide compressor 58. Limiting lateral movement of retainer plate 32 in this manner may help ensure that retainer plate 32 cannot be dislodged, preventing disengagement of retainer plate 32 from shroud retention system 22. Thus, the use of one or more compressor mating features 136, 138 with one or more retainer mating features 180, 182, or 184, 186, may help ensure that shroud 20 may remain attached to edge 18 of working tool 10 during machine operations.

Figure 18:
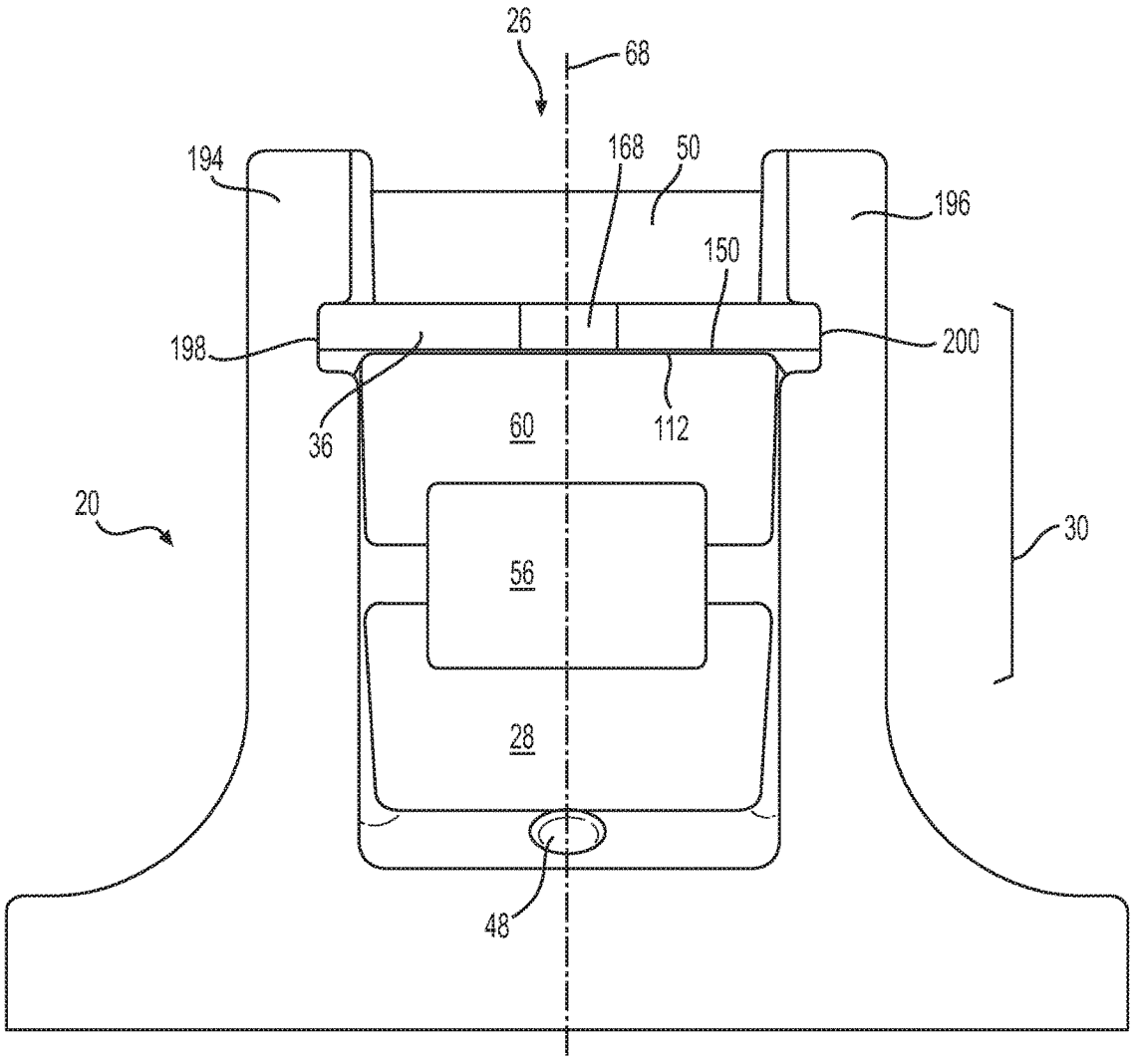
FIG. 18 is a bottom view of the exemplary shroud retention system of FIG. 2.

FIG. 18 illustrates a bottom view of an exemplary disclosed shroud retention system 22. As illustrated in FIG. 18, retainer plate 32 may be slidably attached to first and second legs 194, 196 of channel 50 and may be configured to retain spring assembly 30 between adapter 28 and retainer plate 32. Retainer front face 150 of retainer plate 32 may abut compressor rear face 112 of slide compressor 58. As further illustrated in FIG. 18, first leg 194 of channel 50 may include first retainer slot 198 and second leg 196 of channel 50 may include second retainer slot 200. First retainer slot 198 may extend along first leg 194 from elongated opening 52 of channel 50. Likewise, second retainer slot 200 may extend along second leg 196 of channel 50 from elongated opening 52. First and second retainer slots 198, 200, and elongated opening 52 may allow retainer plate 32 to be inserted through elongated opening 52 and be disposed in first and second retainer slots 198, 200.

Returning to FIG. 16, in a locked position, handle 174 of retainer plate 32 may slidably engage with notch 192 and retainer portion 154 of retainer plate 32 may engage with first and second retainer slots 198, 200. In particular, the biasing force of resilient member 56 may help compressor rear face 112 move retainer plate 32 into its inclined and locked position within channel 50 as illustrated in FIG. 16.

INDUSTRIAL APPLICABILITY

The disclosed shroud retention system may be used with various earth-working machines, such as hydraulic excavators, cable shovels, wheel loaders, front shovels, draglines, and bulldozers. Specifically, the shroud retention system may be used to connect shrouds to work tools of these machines to help protect the work tool edges against wear. A method of retaining shroud 20 on work tool 10 will be described next.

Figure 19:
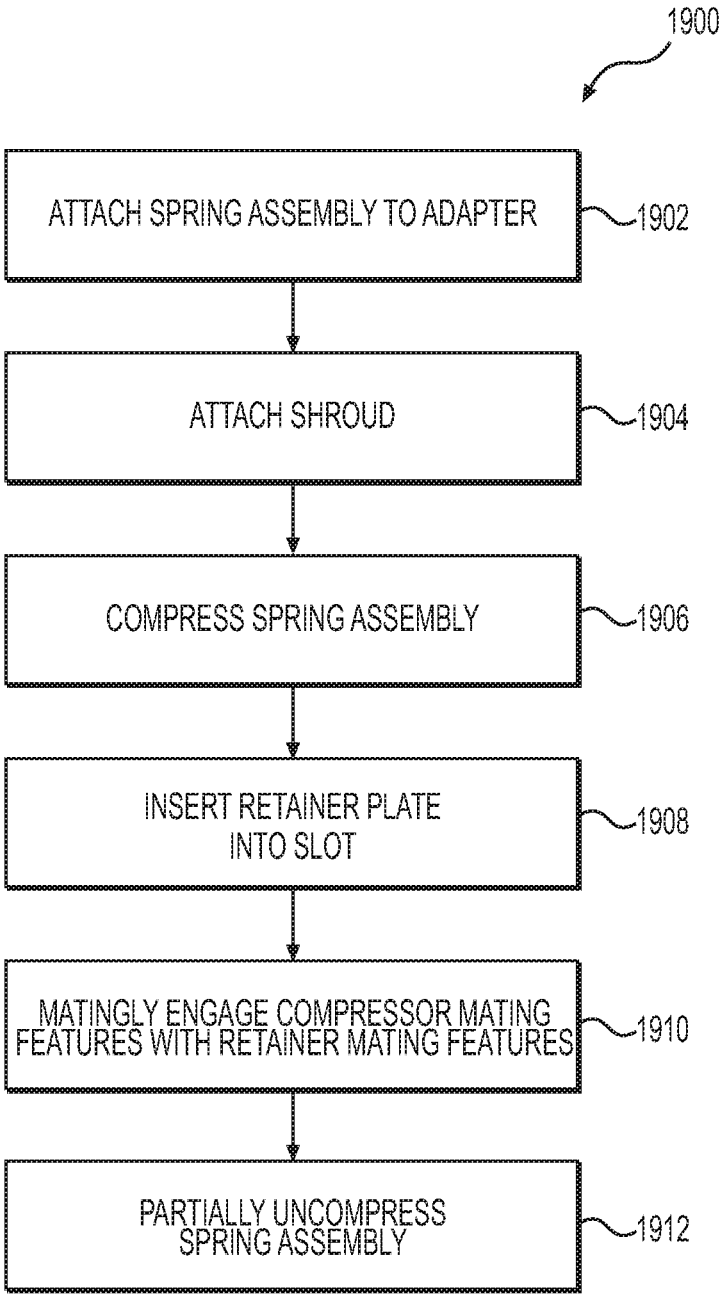
FIG. 19 is a flow-chart of an exemplary method of retaining the shroud of FIG. 3 using the shroud retention system of FIG. 2.

FIG. 19 illustrates a method 1900 of retaining shroud 20 on work tool 10. Method 1900 may include a step of attaching spring assembly 30 to adapter 28 (Step 1902). To attach spring assembly 30 to adapter 28, resilient member 56 may be slidably inserted in recess 100 of adapter 28 adjacent damper proximal end 140 such that damper front face 144 abuts against recess base 102 of adapter 28. Further, slide compressor 58 may slidably attached to resilient member 56 adjacent damper distal end 142 such that damper rear face 146 abuts against recess base 128 of slide compressor 58. Nut 60 may be inserted into slot 66 of slide compressor 58 so that nut 60 is disposed in second hole portion 132 of hole 64 in slide compressor 58.

Method 1900 may include a step of attaching shroud 20 (Step 1904). Attachment portion 38 of shroud 20 may be positioned and pushed rearward toward edge 18 so that adapter 28 and spring assembly 30 may be slidably received in channel 50 of attachment portion 38 of shroud 20. Thus, for example, shroud 20 may be attached such that first and second protrusions 80 and 82 of adapter 28 and first and second protrusions 106 and 108 of slide compressor 58 may be slidably received in recess 74 of channel 50. Likewise, portions of adapter 28 and slide compressor 58 may be slidably received within recess 76 of channel 50.

Method 1900 may include a step of compressing spring assembly 30 (Step 1906). To compress spring assembly 30, bolt 34 may be inserted through holes 48, 54, 64, and 66 of shroud 20, adapter 28, resilient member 56, and slide compressor 58, respectively, so that bolt 34 threadingly engages with nut 60 in slide compressor 58. Turning bolt 34 may cause slide compressor 58 to slidably move towards adapter 28, compressing resilient member 56. Bolt 34 may be turned until elongated opening 52 in attachment portion 38 of shroud 20 is located rearward of compressor rear face 112 of slide compressor 58. In this condition, elongated opening 52 may be disposed between compressor rear face 112 of slide compressor 58 and shroud distal end 26.

Method 1900 may include a step of inserting retainer plate 32 into elongated opening 52 (Step 1908). Retainer plate 32 may be pushed into elongated opening 52 so that first and second retainer side faces 162, 164 slidably engage with first and second retainer slots 198, 200, respectively. Retainer plate 32 may be pushed in through elongated opening 52 until retainer bottom face 158 abuts against upper surface 70 of edge 18. Retainer plate 32 may be in an unlocked position when inserted in this manner through elongated opening 52 because it may be possible to pull retainer plate 32 out of elongated opening 52.

Method 1900 may include a step of matingly engaging one or more of compressor mating features 136, 138 with a corresponding one or more of retainer mating features 180, 182, or 184, 186 (Step 1910). In step 1910, retainer plate 32 may be positioned such that retainer front face 150 may abut on compressor rear face 112. Further, retainer plate 32 may be positioned such that compressor mating feature 136 may engage with retainer mating feature 182, and compressor mating feature 138 may engage with corresponding retainer mating feature 180. For example, when compressor mating features include protrusions 136, 138 and retainer mating features include recesses 180, 182 retainer plate 32 may be positioned so that protrusions 136, 138 enter and engage with recesses 182, 180, respectively, to prevent any lateral motion of retainer plate 32 relative to slide compressor 58.

Method 1900 may include a step of partially uncompressing spring assembly 30 (Step 1912). To partially uncompress spring assembly 30, bolt 34 may be turned to loosen bolt 34 from nut 60. Turning bolt 34 in this manner may allow slide compressor 58 to move away from adapter 28, uncompressing resilient member 56. As bolt 34 is turned to uncompress spring assembly 30, resilient member 56 may exert a biasing force on slide compressor 58 pushing slide compressor 58 away from adapter 28. The biasing force of resilient member 56 may cause compressor rear face 112 of slide compressor 58 to push retainer front face 150 of retainer plate 32 so that retainer plate 32 may be tilted into its locked position. Furthermore, the biasing force of resilient member 56 may cause compressor mating features 136, 138 to fully engage with corresponding retainer mating features 182, 180, respectively. Tilting retainer plate 32 may cause retainer plate 32 to slidingly engage with notch 192 in channel 50 of shroud 20. Thus, retainer front face 150 of retainer plate 32 may abut against notch 192. The biasing force of resilient member 56, the angle of inclination of compressor rear face 112 of slide compressor 58, and the engagement of compressor mating features 136, 138 with retainer mating features 182, 180, respectively, may help push retainer plate 32 against notch 192, preventing retainer plate 32 from being ejected out of elongated opening 52. Likewise, the biasing force of resilient member 56 and the angle of inclination of compressor rear face 112 may help retainer rear face 152 abut against surfaces of first and second retainer slots 198, 200. Thus, by partially uncompressing resilient member 56 to push retainer plate 32 into a locked position, shroud retention system 22 may allow shroud 20 to be attached to work tool 10 without the use of any fasteners.

In one exemplary embodiment, bolt 34 may be completely removed from shroud retention system 22 after partially uncompressing resilient member 56. Bolt 34 may be reusable for assembly and/or disassembly of one or more shroud 20 on the same work tool 10. Further, by using a single resilient member 56 as the compressible element, shroud retention system 22 may help reduce the number of components in the assembly, which may help reduce the cost of operating work tool 10. In addition, because assembly of shroud 20 using the disclosed shroud retention system 22 requires only a linear movement of channel 50 to slidably receive adapter 28 and slide compressor 58, shroud retention system 22 may help simplify the assembly process for shrouds 20 at a work site.

To remove shroud 20 from work tool 10, a pry bar may be inserted through opening 178 to push retainer front face 150 of retainer plate 32 rearward so that retainer front face 150 and handle 174 of retainer plate 32 may disengage from notch 192. Pushing retainer front face 150 rearward may also allow retainer mating features 180, 182 to disengage from corresponding compressor mating features 138, 136, respectively. The pry bar may then be inserted into opening 178 in retainer plate 32 to pull retainer plate 32 out of elongated opening 52. Once retainer plate 32 has been removed, shroud 20 may be slidably disengaged from slide compressor 58 and adapter 28 by pulling shroud 20 towards shroud proximal end 24 and away from edge 18 of work tool 10.

It will be apparent to those skilled in the art that various modifications and variations can be made to the disclosed shroud retention system. Other embodiments will be apparent to those skilled in the art from consideration of the specification and practice of the disclosed shroud retention system. It is intended that the specification and examples be considered as exemplary only, with a true scope being indicated by the following claims and their equivalents.

What is claimed is:

1. A shroud retention system for a work tool, comprising:
an adapter attached to the work tool;
a shroud including a channel configured to slidably engage with the adapter, the channel including a retainer slot;
a spring assembly disposed in the channel, the spring assembly being connectable to the adapter, the spring assembly including:
a slide compressor configured to slidably move in the channel relative to the adapter, the slide compressor including a compressor mating feature; and
a resilient member disposed between the adapter and the slide compressor, the resilient member being configured to be compressed by the slide compressor; and
a retainer plate disposed in the retainer slot, the retainer plate including a retainer mating feature configured to matingly engage with the compressor mating feature such that the retainer plate and the slide compressor are engaged in a locked position, wherein
the compressor mating feature includes a pair of protrusions disposed spaced apart from each other on a rear face of the slide compressor, and
the retainer mating feature includes a pair of recesses disposed spaced apart from each other on a retainer front face, the pair of recesses being configured to receive the pair of protrusions.

2. The shroud retention system of claim 1, wherein the compressor mating feature includes at least one protrusion extending outward from a surface of the slide compressor.

3. The shroud retention system of claim 2, wherein the retainer mating feature includes at least one recess configured to receive the at least one protrusion.

4. The shroud retention system of claim 3, wherein the at least one protrusion and the at least one recess may have one of a square shape, a circular shape, an elliptical shape, a polygonal shape, or a cross shape.

5. The shroud retention system of claim 1, wherein
the slide compressor includes a compressor block including a front face abutting on the resilient member and a rear face disposed opposite the front face, and
the compressor mating feature includes a recess extending into the compressor block from the rear face towards the front face.

6. The shroud retention system of claim 1, further including a fastener configured to threadingly engage with the slide compressor.

7. The shroud retention system of claim 6, wherein the slide compressor includes a nut configured to engage with the fastener.

8. The shroud retention system of claim 7, wherein
the slide compressor includes:
a compressor block including a front face abutting on the resilient member and a rear face disposed opposite the front face, and
a hole extending between the front face and the rear face, the hole being configured to receive the fastener,
the compressor mating feature is a first compressor mating feature,
the slide compressor includes a second compressor mating feature, and
the first compressor mating feature and the second compressor mating feature are disposed on opposite sides of the hole.

9. The shroud retention system of claim 8, wherein either of the first compressor mating feature or the second compressor mating feature includes one of a protrusion extending outward from the rear face, or a recess extending into the compressor block from the rear face into the compressor block.

10. The shroud retention system of claim 8, wherein the first compressor mating feature and the second compressor mating feature are disposed equidistant from the hole.

11. The shroud retention system of claim 1, wherein the pair of recesses is a first pair of recesses, and the retainer plate further includes:
a slot configured to receive a fastener configured to threadingly engage with the slide compressor; and
a second pair of recesses disposed spaced apart from each other on a retainer rear face, the second pair of recesses being disposed on opposite sides of the slot.

12. The shroud retention system of claim 1, wherein
the retainer plate includes:
a retainer front face facing the slide compressor; and
a retainer rear face disposed opposite the retainer front face, and
the retainer mating feature includes:
a first pair of mating features disposed on the retainer front face; and
a second pair of mating features disposed on the retainer rear face.

13. The shroud retention system of claim 12, wherein any of the first pair of mating features or of the second pair of mating features includes one of a protrusion projecting outwards from the retainer plate or a recess extending into the retainer plate from a respective one of the retainer front face or the retainer rear face.

14. A slide compressor for attaching a work tool, the slide compressor comprising:
a compressor block, including:
a compressor front face;

a compressor rear face disposed opposite the compressor front face, the compressor rear face being inclined relative to the compressor front face;

a compressor bottom face extending from the compressor front face to the compressor rear face;

a compressor top face disposed opposite the compressor bottom face and extending from the compressor front face to the compressor rear face;

a hole extending between the compressor front face and the compressor rear face, the compressor front face being disposed generally perpendicular to a longitudinal axis of the hole;

a slot extending from the compressor top face towards the compressor bottom face and intersecting with the hole; and a protrusion disposed on the compressor rear face.

15. The slide compressor of claim 14, wherein the protrusion is a first protrusion and the slide compressor further includes a second protrusion disposed on the compressor rear face, the first and second protrusions being disposed on opposite sides of the hole.

16. The slide compressor of claim 15, wherein the first protrusion is spaced apart from the hole by a first distance, and the second protrusion is spaced apart from the hole by a second distance different from the first distance.

17. The slide compressor of claim 16, wherein the protrusion has one of a square shape, a rectangular shape, a polygonal shape, or a circular shape.

18. The slide compressor of claim 14, further including a recess extending into the compressor block from the compressor rear face towards the compressor front face.

19. A retainer plate, comprising:

a retainer front face;

a retainer rear face disposed opposite the retainer front face;

a retainer portion, including:

a retainer bottom face extending between the retainer front face and the retainer rear face;

a retainer top face extending between the retainer front face and the retainer rear face; and retainer side faces extending between the retainer front face and the retainer rear face;

a slot extending from the retainer bottom face towards the retainer top face; and a recess disposed on at least one of the retainer front face or the retainer rear face, wherein the recess is a first recess disposed on the retainer front face, and the retainer includes a second recess disposed on the retainer front face, the first and second recesses disposed on opposite sides of the slot.

20. The retainer of claim 19, wherein the retainer plate further includes:

a third recess disposed on the retainer rear face; and a fourth recess disposed on the retainer rear face, the third and fourth recesses being disposed on opposite sides of the slot.

21. The retainer of claim 19, wherein the first and second recesses are disposed asymmetrically relative to a slot axis of symmetry.

* * * * *